US011022922B2

(12) United States Patent
Saito et al.

(10) Patent No.: US 11,022,922 B2
(45) Date of Patent: Jun. 1, 2021

(54) IMAGE FORMING APPARATUS AND INTERMEDIATE TRANSFER MEMBER

(71) Applicant: CANON KABUSHIKI KAISHA, Tokyo (JP)

(72) Inventors: Shuji Saito, Suntou-gun (JP); Seiji Nakahara, Sakura (JP); Ken Yokoyama, Mishima (JP); Hiroshi Kita, Mishima (JP); Koujirou Izumidate, Chiba (JP); Kazushi Ino, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/901,438

(22) Filed: Jun. 15, 2020

(65) Prior Publication Data

US 2020/0401073 A1 Dec. 24, 2020

(30) Foreign Application Priority Data

Jun. 20, 2019 (JP) ..... JP2019-115036

(51) Int. Cl.
*G03G 15/00* (2006.01)
*G03G 15/16* (2006.01)

(52) U.S. Cl.
CPC ..... *G03G 15/5054* (2013.01); *G03G 15/162* (2013.01)

(58) Field of Classification Search
CPC ..... G03G 15/5054; G03G 15/162
See application file for complete search history.

(56) References Cited

U.S. PATENT DOCUMENTS 6,643,487 B1 * 11/2003 Shimmura ..... G03G 15/162 399/302
7,266,329 B2 9/2007 Matsuo
7,546,075 B2 6/2009 Hirai
8,518,616 B2 8/2013 Sakimura
(Continued)

FOREIGN PATENT DOCUMENTS

JP 2007132960 A 5/2007
JP 2010250355 A 11/2010
(Continued)

*Primary Examiner* — Sandra Brase
(74) *Attorney, Agent, or Firm* — Rossi, Kimms & McDowell LLP

(57) ABSTRACT

An image forming apparatus including: a movable intermediate transfer member onto which a toner image borne by an image bearing member is to be transferred; a detection unit configured to irradiate the toner image on the intermediate transfer member with light to detect reflected light; and a control unit configured to adjust a condition for forming the toner image based on a detection result of the detection unit, wherein a plurality of grooves extending along a movement direction of the intermediate transfer member are formed in a surface of the intermediate transfer member in a width direction intersecting the movement direction, and wherein grooves, formed within a range of the intermediate transfer member to which the light is irradiated by the detection unit, among the plurality of grooves are formed so that intervals each between adjacent grooves with respect to the width direction are regularly changed within a predetermined range.

19 Claims, 12 Drawing Sheets

(56) References Cited

U.S. PATENT DOCUMENTS

| | | | | |
|---|---|---|---|---|
| 9,195,176 | B2 | 11/2015 | Seki | |
| 2010/0300604 | A1* | 12/2010 | Goss | G03G 15/162 156/154 |
| 2012/0237233 | A1* | 9/2012 | Kato | G03G 15/5054 399/49 |
| 2015/0177653 | A1* | 6/2015 | Seki | G03G 15/162 399/101 |
| 2016/0109832 | A1* | 4/2016 | Ohsugi | G03G 15/162 399/314 |

FOREIGN PATENT DOCUMENTS

| | | | |
|---|---|---|---|
| JP | 4677509 | B2 | 4/2011 |
| JP | 2011209708 | A | 10/2011 |
| JP | 5697527 | B2 | 4/2015 |
| JP | 2015125187 | A | 7/2015 |

* cited by examiner

IMAGE FORMING APPARATUS AND INTERMEDIATE TRANSFER MEMBER

BACKGROUND OF THE DISCLOSURE

Field of the Disclosure

The present disclosure relates to an image forming apparatus such as a laser printer, a copying machine, or a facsimile apparatus using an electrophotographic method or an electrostatic recording method, and an intermediate transfer member to be used for the image forming apparatus.

Description of the Related Art

Hitherto, as an image forming apparatus using an electrophotographic method, there has been given, for example, an image forming apparatus using an intermediate transfer method including an intermediate transfer member. In this image forming apparatus, toner images formed on photosensitive members are transferred to the intermediate transfer member at a primary transfer portion, and after that, the toner images on the intermediate transfer member are secondarily transferred to a recording material at a secondary transfer portion. An intermediate transfer belt formed of an endless belt has been widely used as the intermediate transfer member.

In the image forming apparatus using the intermediate transfer method, toner remains on the intermediate transfer belt after the secondary transfer step (secondary transfer residual toner). Therefore, it is required to perform a cleaning step of removing the secondary transfer residual toner from the intermediate transfer belt before transfer of the next image to the intermediate transfer belt. For this cleaning step, a blade cleaning method has been widely used. In the blade cleaning method, through use of a cleaning blade serving as a cleaning member provided on downstream of the secondary transfer portion in a movement direction of a surface of the intermediate transfer belt (hereinafter referred to also as "belt conveyance direction"), the secondary transfer residual toner is physically scraped off the moving intermediate transfer belt. As the cleaning blade, in general, an elastic body made of, for example, urethane rubber is used. In many cases, this cleaning blade is arranged so as to extend in a counter direction with respect to the belt conveyance direction, and an edge portion at a free end portion thereof is brought into press-contact with the surface of the intermediate transfer belt. The arranging the cleaning blade so as to extend in the counter direction with respect to the belt conveyance direction corresponds to arranging the cleaning blade so that the free end portion thereof is located on an upstream side in the belt conveyance direction with respect to a fixed end portion of the cleaning blade.

Here, for example, in order to reduce a frictional force between the cleaning blade and the intermediate transfer belt to thereby suppress wear of the cleaning blade and improve durability of the cleaning blade, a certain shape is given to the surface of the intermediate transfer belt. In Japanese Patent Application Laid-Open No. 2015-125187, it is disclosed that grooves are formed in the surface of the intermediate transfer belt by forming irregularities on the surface of the intermediate transfer belt with use of a wrapping film.

Moreover, in the image forming apparatus using the intermediate transfer method, in order to achieve high color reproducibility and output a high-resolution image, a test toner image formed on the intermediate transfer belt is detected with use of a detection unit, and image density control and process control are adjusted (corrected). In Japanese Patent Application Laid-Open No. 2007-132960, it is disclosed that a density of a predetermined test toner image is detected and that a position of the predetermined test toner image is detected.

The adjustment (correction) with use of the test toner image is hereinafter referred to also as "calibration". Moreover, the test toner image is hereinafter referred to also as "calibration patch" or, more simply, "patch". As the detection unit for the calibration, in general, an optical sensor is used because the optical sensor is inexpensive and has high resolution. Through the calibration with use of the optical sensor, the density or the presence/absence (position) of the patch can be detected based on a difference or a ratio of reflectance of light between a portion covered with the patch and other portion on the intermediate transfer belt.

For the calibration with use of the optical sensor as described above, the reflectance of the light reflected from the intermediate transfer belt or from the patch is used. Therefore, the calibration is liable to be influenced by surface characteristics of the intermediate transfer belt.

SUMMARY OF THE DISCLOSURE

The present disclosure provides an image forming apparatus and an intermediate transfer member, which are capable of suppressing degradation in accuracy of calibration even when a projection/recess shape is given to a surface of the intermediate transfer member.

The object described above is achieved with an image forming apparatus and an intermediate transfer member according to an embodiment of the present disclosure. To put it in a simple way, an image forming apparatus including: an image bearing member configured to bear a toner image; an intermediate transfer member, onto which the toner image is to be transferred from the image bearing member, and which is movable; a detection unit configured to irradiate the toner image on the intermediate transfer member with light to detect reflected light; and a control unit configured to perform control of adjusting a condition for forming the toner image based on a detection result of the detection unit, wherein, in a surface of the intermediate transfer member, a plurality of grooves extending along a movement direction of the surface of the intermediate transfer member are formed side by side in a width direction of the intermediate transfer member intersecting the movement direction, and wherein grooves, formed within a range of the intermediate transfer member to which the light is irradiated by the detection unit with respect to at least the width direction, among the plurality of grooves are formed so that intervals each between adjacent grooves with respect to the width direction are regularly changed within a predetermined range.

Further features of the present invention will become apparent from the following description of exemplary embodiments with reference to the attached drawings.

DESCRIPTION OF THE EMBODIMENTS

Now, an image forming apparatus and an intermediate transfer member according to the embodiments of the present disclosure will be described in detail with reference to the drawings.

First Embodiment

1. Overall Configuration and Operation of Image Forming Apparatus

Figure 1:
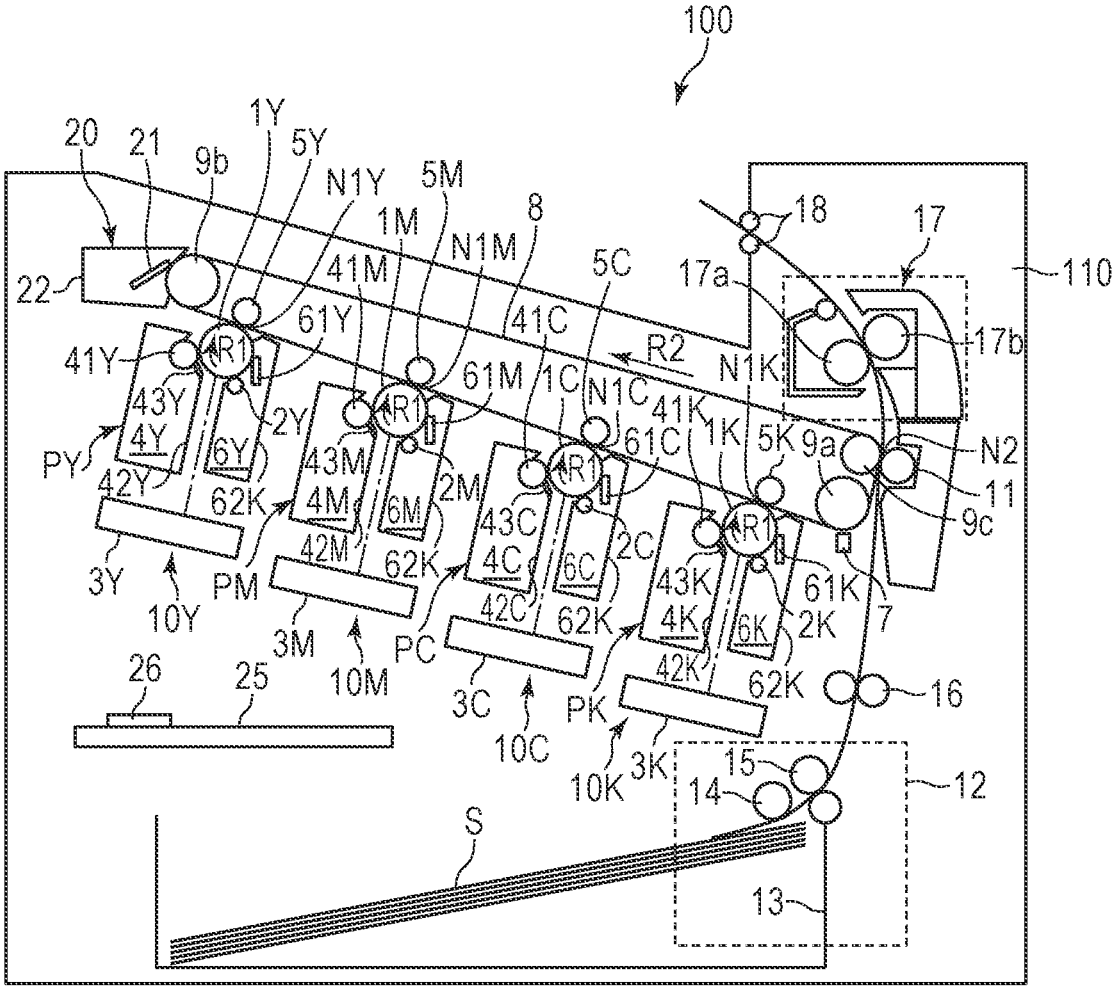
FIG. 1 is a schematic sectional view for illustrating an image forming apparatus.

FIG. 1 is a schematic sectional view for illustrating an image forming apparatus 100 according to a first embodiment. The image forming apparatus 100 according to the first embodiment is a laser beam printer of an in-line type employing an intermediate transfer method, which is capable of forming a full-color image at a process speed of 210 mm/s and a resolution of 600 dpi with use of an electrophotographic method and is adaptable to a sheet of Legal size.

The image forming apparatus 100 includes, as a plurality of image forming portions, four stations 10Y, 10M, 10C, and 10K configured to form images of yellow (Y), magenta (M), cyan (C), and black (K), respectively. Components of the stations 10Y, 10M, 10C, and 10K having the same or corresponding functions or configurations are sometimes correctively described without characters Y, M, C, and K, which are added to ends of reference symbols for indication of corresponding colors. In the first embodiment, the station 10 includes, for example, a photosensitive drum 1, a charging roller 2, an exposure device 3, a developing device 4, a primary transfer roller 5, and a drum cleaning device 6, which are described later.

The photosensitive drum 1, which is a rotatable drum-type (cylindrical) photosensitive member (electrophotographic photosensitive member) serving as an image bearing member configured to bear a toner image, is driven to rotate in an arrow R1 direction (clockwise direction) of FIG. 1 by a drive motor (not shown) serving as a drive unit. A surface of the rotating photosensitive drum 1 is charged to a predetermined potential having a predetermined polarity (negative polarity in the first embodiment) by the charging roller 2 being a roller-shaped charging member serving as a charge unit. The surface of the photosensitive drum 1 having been charged is subjected to scanning exposure by the exposure device 3 serving as an exposure unit in accordance with image information. As a result, an electrostatic latent image (electrostatic image) is formed on the photosensitive drum 1. In the first embodiment, the exposure device 3 is formed of a scanner unit configured to scan a laser beam with use of a polygon mirror, and is configured to irradiate the photosensitive drum 1 with a scanning beam having been modulated based on an image signal. The electrostatic latent image having been formed on the photosensitive drum 1 is developed (formed into a visible image) with toner serving as a developer supplied thereto by the developing device 4 serving as a developing unit. As a result, a toner image is formed on the photosensitive drum 1.

An intermediate transfer belt 8, which is formed of an endless belt serving as a movable intermediate transfer member, is arranged so as to be opposed to four photosensitive drums 1. The intermediate transfer belt 8 is stretched around a drive roller 9*a*, a tension roller 9*b*, and a secondary transfer opposing roller (secondary transfer inner roller) 9*c*, which serve as a plurality of support rollers (stretching rollers). A driving force is transmitted to the intermediate transfer belt 8 with the drive roller 9*a* driven to rotate by a drive motor (not shown) serving as a drive unit so that the intermediate transfer belt 8 revolves (rotates) in an R2 direction (counterclockwise direction) of FIG. 1. In the first embodiment, the intermediate transfer belt 8 is an endless belt having a length of 250 mm in a width direction (hereinafter referred to also as "belt width direction") substantially orthogonal to a belt conveyance direction (movement direction of the surface) and a circumferential length of 712 mm. Moreover, in the first embodiment, a tensile force (tension) of 100 N is applied to the overall width of the intermediate transfer belt 8 by the tension roller 9*b*. The intermediate transfer belt 8 is described more in detail later. On an inner peripheral surface side of the intermediate transfer belt 8, primary transfer rollers 5 being roller-shaped primary transfer members serving as a primary transfer unit are arranged. The primary transfer rollers 5 are pressed against the photosensitive drums 1 through intermediation of the intermediate transfer belt 8, thereby forming primary transfer portions (primary transfer nips) N1 at which the photosensitive drums 1 and the intermediate transfer belt 8 are in contact with each other. The toner images having been formed on the photosensitive drums 1 as mentioned above are primarily transferred to the revolving intermediate transfer belt 8 at the primary transfer portions N1 by an action of the primary transfer rollers 5. At the time of the primary transfer, a primary transfer voltage (primary transfer bias) having a polarity opposite to a regular charge polarity of the toner (charge polarity given at the time of developing) is applied to each of the primary transfer rollers 5. For example, at the time of forming a full-color image, the toner images of respective colors of Y, M, C, and K formed on the photosensitive drums 1 are sequentially transferred in superimposition to the intermediate transfer belt 8 at the primary transfer portions N1.

On an outer peripheral surface side of the intermediate transfer belt 8, at a position opposed to the secondary transfer opposing roller 9*c*, a secondary transfer roller (secondary transfer outer roller) 11 being a roller-shaped secondary transfer member serving as a secondary transfer unit is arranged. The secondary transfer roller 11 is pressed against the secondary transfer opposing roller 9*c* through intermediation of the intermediate transfer belt 8, thereby forming a secondary transfer portion (secondary transfer nip) N2 at which the intermediate transfer belt 8 and the secondary transfer roller 11 are in contact with each other. The toner image having been formed on the intermediate transfer belt 8 as mentioned above is secondarily transferred to a recording material (transfer material or sheet) S such as a paper sheet being nipped between the intermediate transfer belt 8 and the secondary transfer roller 11 and conveyed by an action of the secondary transfer roller 11 at the secondary transfer portion N2. At the time of the secondary transfer, a secondary transfer voltage (secondary transfer bias) having a polarity opposite to the regular charge polarity of the toner is applied to the secondary transfer roller 11. In a feed-conveyance device 12, the recording material S is sent out from a sheet feeding cassette 13 accommodating the recording material S by a feed roller 14 configured to feed the recording material S, and is conveyed by a conveyance roller pair 15 configured to convey the recording material S. Then, the recording material S is conveyed to the secondary transfer nip portion N2 with a timing of conveyance of the recording material S being synchronized with a timing of conveyance of the toner image on the intermediate transfer belt 8 by a registration roller pair 16.

The recording material S having the toner image transferred thereto is conveyed to a fixing device 17 serving as a fixing unit. The fixing device 17 heats and pressurizes the recording material S with use of an endless fixing film 17*a*, which has a heat source incorporated therein, and a pressure roller 17*b*, thereby fixing (melting and firmly fixing) the toner image on the surface of the recording material S. The recording material S having the toner image fixed thereon is delivered (output) by a delivery roller pair 18 to an outside of an apparatus main body 110 of the image forming apparatus 100.

Moreover, toner which remains on the surface of the photosensitive drum 1 at the time of the primary transfer (primary transfer residual toner) is removed from the photosensitive drum 1 and collected by the drum cleaning device 6 serving as a photosensitive member cleaning unit. The drum cleaning device 6 uses a cleaning blade 61, which is arranged in abutment against the surface of the photosensitive drum 1 and serves as a cleaning member, to scrape off the primary transfer residual toner from the surface of the rotating photosensitive drum 1 and stores the toner in a cleaning container 62. Moreover, on the outer peripheral surface side of the intermediate transfer belt 8, a belt cleaning device 20 serving as an intermediate transfer member cleaning unit is arranged on downstream of the secondary transfer portion N2 and upstream of the primary transfer portion N1 (upstream-most primary transfer portion N1Y) in the belt conveyance direction. In the first embodiment, the belt cleaning device 20 is arranged at a position opposed to the tension roller 9*b* through intermediation of the intermediate transfer belt 8. Toner which remains on the surface of the intermediate transfer belt 8 at the time of the secondary transfer (secondary transfer residual toner) or paper powder are removed from the intermediate transfer belt 8 and collected by the belt cleaning device 20. The belt cleaning device 20 scrapes off, for example, the secondary transfer residual toner from the surface of the revolving intermediate transfer belt 8 with use of a cleaning blade 21, which is arranged in abutment against the surface of the intermediate transfer belt 8 and serves as a cleaning member, and stores the toner in a cleaning container 22.

In the first embodiment, in each of the stations 10, the photosensitive drum 1 and the charging roller 2, the developing device 4, and the drum cleaning device 6 serving as process units which act on the photosensitive drum 1 are integrated into a cartridge to form a process cartridge P. The process cartridge P is mountable to and removable from the apparatus main body 110. Four process cartridges PY, PM, PC, and PK have substantially the same structures, and are different from each other in that toners of Y, M, C, and K are stored, respectively.

Moreover, in the first embodiment, the developing device 4 uses a non-magnetic one-component developer as the developer. This developing device 4 includes, for example, a developing roller 41 serving as a developer bearing member, a developing container 42 configured to store the developer, and a developing blade 43 serving as a developer regulating unit. In the first embodiment, at an exposure portion (image portion) on the photosensitive drum 1 having been reduced in absolute value of the potential as a result of exposure after the uniform charging, the toner having been charged to the same polarity as the charge polarity of the photosensitive drum 1 (negative polarity in the first embodiment) adheres (reversal development). At the time of developing, the developing roller 41 bearing the toner is brought into abutment against or brought close to the photosensitive drum 1, and a predetermined developing voltage (developing bias) of the negative polarity is applied to the developing roller 41.

Moreover, the toner used in the first embodiment is obtained by adding silica fine particles having an average particle diameter of 20 nm to toner particles having an average particle diameter of 6.4 and is charged to the negative polarity. Here, the average particle diameter corresponds to an average of particle diameters determined based on particle volumes which can be measured by, for example, a coulter method. The measurement can be performed with use of, for example, "Coulter Counter Multisizer 3" (manufactured by Beckman Coulter) and "Beckman Coulter Multisizer 3. Version 3.51" (manufactured by Beckman Coulter), which is attached specialized software for measurement condition setting and measurement data analysis. Moreover, in the first embodiment, the toner particles are manufactured by an emulsion polymerization and coagulation method. However, the manufacturing method for the toner particles is not limited to the emulsion polymerization and coagulation method, and the toner particles can be manufactured by other method such as a grinding technique, a suspension polymerization method, or a dissolution suspension method.

Moreover, in the first embodiment, the cleaning blade 21 of the belt cleaning device 20 is obtained by affixing an elastic blade made of an elastic material to a support sheet metal serving as a support member. In the first embodiment, as the support plate metal, a zinc-plated steel sheet having a substantially rectangular plate shape with a length of 240 mm on a longitudinal surface arranged along a belt width direction and a thickness of 3 mm is used. Moreover, in the first embodiment, as the elastic blade, a urethane rubber blade having a substantially rectangular plate shape with a length of 230 mm on a longitudinal surface arranged along the belt width direction, a thickness of 2 mm, and a hardness of 77 degrees in JIS K 6253 standard. In the first embodiment, this cleaning blade 21 is brought into press-contact with the tension roller 9*b* through intermediation of the intermediate transfer belt 8 with a pressurizing force corresponding to a linear load of about 0.49 N/cm. Moreover, this cleaning blade 21 is arranged so as to extend in a counter direction with respect to the belt conveyance direction, and an edge portion at a free end portion thereof is brought into abutment against the surface of the intermediate transfer belt 8.

Moreover, the image forming apparatus 100 according to the first embodiment includes optical sensors 7 serving as a detection unit configured to detect toner on the intermediate transfer belt 8. In the first embodiment, two optical sensors 7 are arranged along the belt width direction so that respective centers of detection positions are located at positions apart by 100 mm from the center in the belt width direction toward both end portion sides. Moreover, in the first embodiment, the optical sensors 7 are arranged at positions opposed to the drive roller 9*a* serving as an opposing member through intermediation of the intermediate transfer belt 8. The optical sensors 7 are configured to detect calibration patches being test toner images formed on the intermediate transfer belt 8. The optical sensors 7 are described more in detail later.

Moreover, the image forming apparatus 100 includes a control board 25 to which an electric circuit configured to control the image forming apparatus 100 is mounted. A CPU 26 is mounted to the control board 25. The CPU 26 executes, for example, controls exemplified below to collectively control operations of the image forming apparatus 100. Examples of the control include control for a drum drive motor being a drive source for the photosensitive drum 1, a belt drive motor being a drive source for the intermediate transfer belt 8, and drive sources relating to conveyance of the recording material S, such as conveyance drive motors being drive sources for the feed-conveyance device 12, the registration roller pair 16, and the fixing device 17. Moreover, examples of the control include control for various image signals relating to image formation. Moreover, examples of the control include density correction control (gradation control) based on detection results of the optical sensors 7. Further, examples of the control include control relating to failure detection. The CPU 26 is an example of a control unit configured to perform control based on detection results of the optical sensors 7.

2. Optical Sensor

Figure 2:
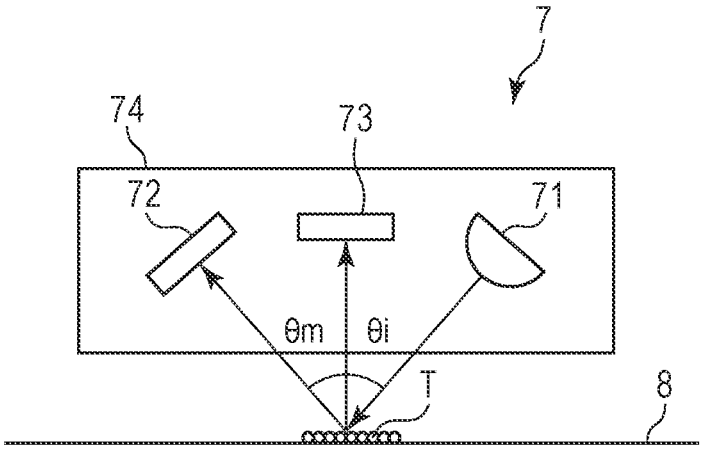
FIG. 2 is a sectional view for schematically illustrating an optical sensor.

Next, the optical sensor 7 (detection unit) of the first embodiment is described. FIG. 2 is a sectional view for schematically illustrating the optical sensor 7.

The optical sensor 7 includes a light emitting element 71, a regular reflection light receiving element 72, a diffused reflection light receiving element 73, and a holder 74. The light emitting element 71 is formed of, for example, a light emitting diode (LED). The regular reflection light receiving element 72 is formed of, for example, a photodiode. The diffused reflection light receiving element 73 is formed of, for example, a photodiode. The optical sensor 7 may further include, on a side surface of the holder 74 on the intermediate transfer belt 8 side, a protection cover (not shown), which is capable of allowing light to pass therethrough and is configured to protect the light emitting element 71, the regular reflection light receiving element 72, and the diffused reflection light receiving element 73. As the optical sensor 7, there may be used an optical sensor including, as a light source, a light emitting diode configured to emit light falling within a range of from a visible light region to a near-infrared region, that is, light having a wavelength of from 400 nm to 1,000 nm.

The optical sensor 7 irradiates from the light emitting element 71 to the surface of the intermediate transfer belt 8 or a patch T on the intermediate transfer belt 8 with light and receives reflected light from the surface of the intermediate transfer belt 8 or the patch T with the regular reflection light receiving element 72 and the diffused reflection light receiving element 73. The regular reflection light receiving element 72 and the diffused reflection light receiving element 73 are each configured to output an electric signal in accordance with an amount of received light. With this, the density of the patch T can be measured based on surface characteristics of the intermediate transfer belt 8 or a ratio or a difference between a reflectance of the patch T and a reflectance of the intermediate transfer belt 8. Here, the reflected light from the patch T contains both a regular reflection component and a diffused reflection (diffusion) component. The regular reflection light receiving element 72 is configured to receive the reflected light containing both the regular reflection component and the diffused reflection component, and the diffused reflection light receiving element 73 is configured to receive only the diffused reflection component.

In the first embodiment, as the light emitting element 71, a near-infrared LED having a center wavelength $\lambda$=840 nm is used. When a normal direction of the intermediate transfer belt 8 is 0°, the light emitting element 71 irradiates the surface of the intermediate transfer belt 8 with light at an incident angle $\theta i$=−20° within a circular range having a diameter of about 2 mm (hereinafter referred to as "spot diameter"). The "spot diameter" corresponds to a size of a detection range of the optical sensor 7 on the intermediate transfer belt 8, and is represented here by a size of the detection range in the belt width direction. Moreover, in the first embodiment, when the normal direction of the intermediate transfer belt 8 is 0° as described above, the reflected light from the intermediate transfer belt 8 or the patch T is received by the regular reflection light receiving element 72 at an angle of +20° and by the diffused reflection light receiving element 73 at an angle of 0°.

3. Calibration

Figure 3A:
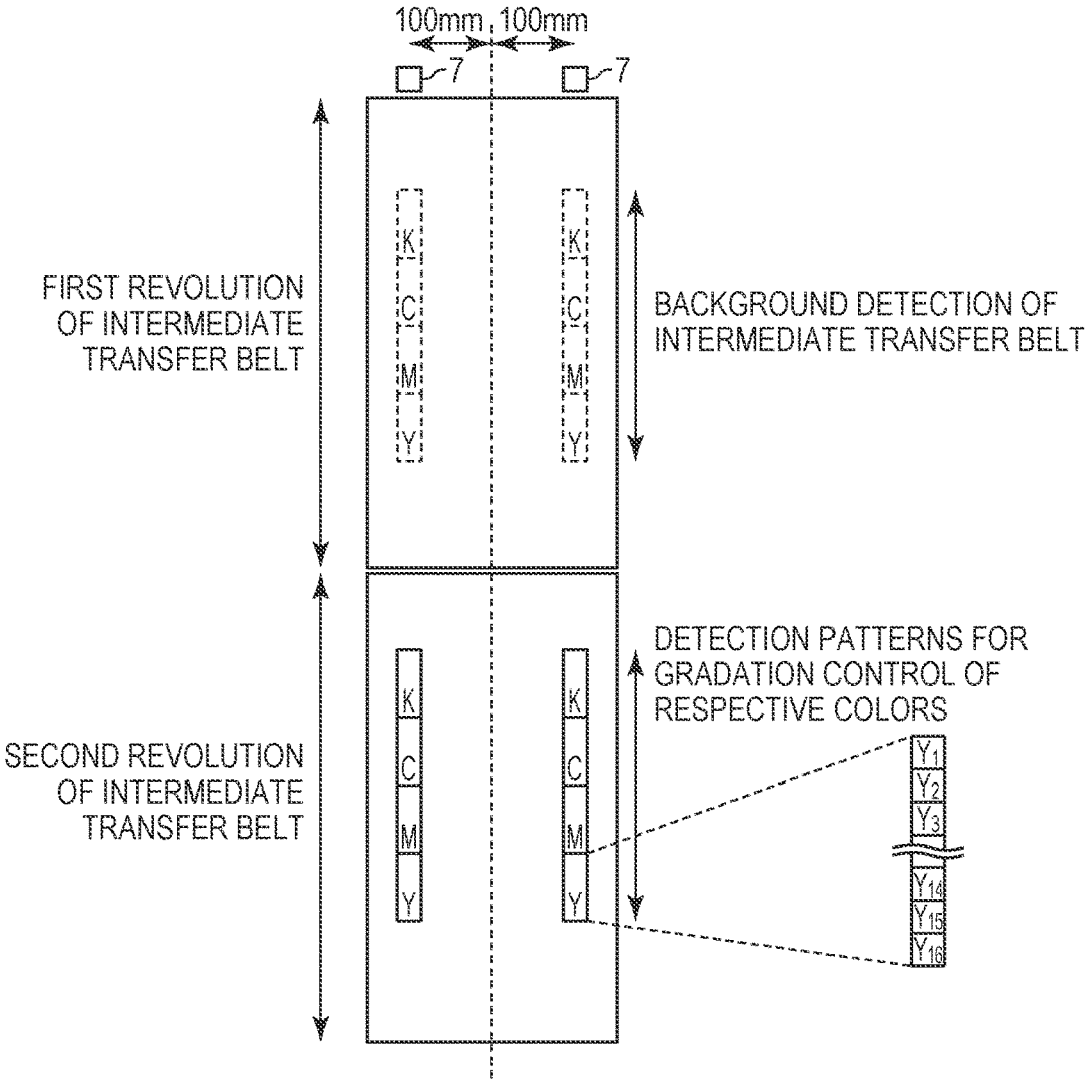
FIG. 3A is a schematic view for illustrating calibration patterns.
Figure 3B:
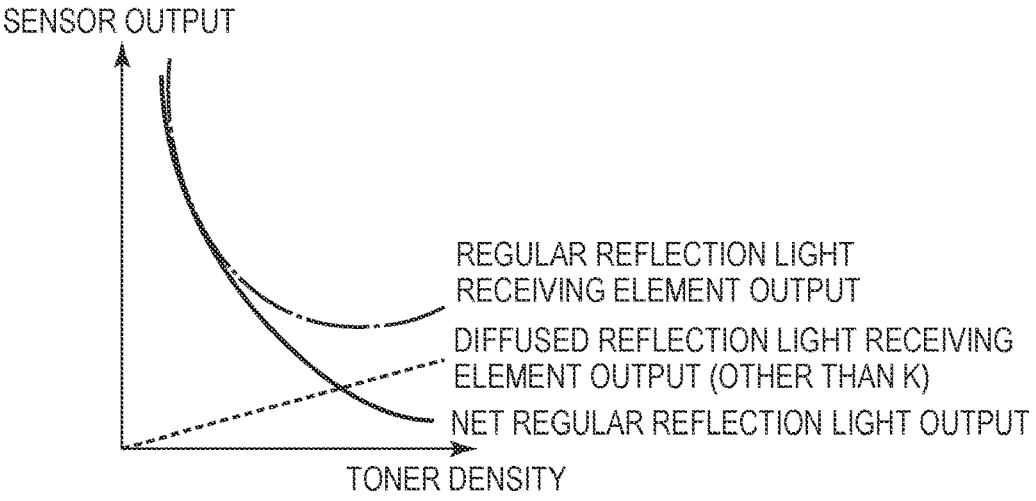
FIG. 3B is a graph for showing a relationship between a toner density of a patch and an output of the optical sensor.

Next, calibration of the first embodiment is described. FIG. 3A is a schematic view for illustrating an outline of calibration patterns each formed of a plurality of patches T. FIG. 3B is a graph for showing a relationship between a toner density (toner placement amount) of the patch T and an output of the optical sensor 7.

In the calibration, at the time of non-image formation (period other than the time of image formation being a period in which an image to be transferred and output to the recording material S is formed), the CPU 26 forms calibration patterns each formed of a plurality of patches T on the intermediate transfer belt 8 while changing image forming conditions. In the first embodiment, the calibration patterns are formed at two locations on the intermediate transfer belt 8 opposed to the two optical sensors 7 arranged at two locations in the belt width direction. Moreover, the CPU 26 detects the density of each of the patches T of the calibration patterns with use of the optical sensors 7. Then, the CPU 26 controls (corrects or adjusts) a gradation correction table based on detection results. The gradation correction table is information to be used for conversion of image information input to the image forming apparatus 100 into a signal for operating each part of the image forming apparatus 100 so that desired gradation characteristics can be obtained in an output image in accordance with characteristics or a state of the image forming apparatus 100. The characters K, C, M, and Y indicated in the second revolution of the intermediate transfer belt 8 in FIG. 3A represent calibration patterns (detection patterns for gradation control) each formed of a plurality of patches T of respective colors including black, cyan, magenta, and yellow. The calibration patterns of respective colors each include patches T of sixteen different densities. The optical sensor 7 irradiates each of the patches T of the calibration patterns of respective colors with light, which is formed on the intermediate transfer belt 8 to detect a reflected light amount.

The surface of the intermediate transfer belt 8 has luster. When the patch T having a high density is formed on the intermediate transfer belt 8 so that the surface of the intermediate transfer belt 8 is covered, as shown in FIG. 3B, the light is blocked by the toner, and the regular reflection light is reduced, thereby reducing the output of the regular reflection light receiving element 72. Meanwhile, the yellow, magenta, and cyan toners have characteristics of being diffused and reflected with respect to infrared light of 840 nm used in the first embodiment. Therefore, when the adhesion amount of the toner on the intermediate transfer belt 8 increases, with regard to the yellow, magenta, and cyan, the output of the diffused reflection light receiving element 73 increases. With use of a difference obtained by subtracting the output of the diffused reflection light receiving element 73 from the output of the regular reflection light receiving element 72, the reflected light amount of only the regular reflection component can be obtained. In the first embodiment, in such a manner, the density ranging from the high density to the low density can be detected with high accuracy.

Meanwhile, in the first revolution of the intermediate transfer belt 8 illustrated in FIG. 3A, the reflected light amount from the surface (background) of the intermediate transfer belt 8 over the lengths of the calibration patterns of K, C, M, and Y in at least the belt conveyance direction is detected. This is because the reflected light amount from the patches T changes under the influence of not only the density of the patches T but also the reflected light amount from the surface of the intermediate transfer belt 8. That is, this is for the purpose of cancelling unevenness of the reflected light amount from the surface of the intermediate transfer belt 8 to obtain the reflected light amount from the patches T with high accuracy. That is, an output value of the optical sensor 7 obtained by subtracting the reflected light amount from the surface of the intermediate transfer belt 8 in the same phase in the first revolution (detection result of background) from the reflected light amount from each of the patches T in the second revolution of the intermediate transfer belt 8 (detection result of patch T) corresponds to a detection value representing density information of the patch T. The patches T described above correspond to the first to sixteenth patches T of each of the calibration patterns of respective colors described above.

The gradation correction table can be controlled (corrected or adjusted), briefly, as follows. Based on the detection results of the optical sensor 7 obtained in the manner described above, a deviation between an ideal density, based on image information of each of the patches T, and an actual density is detected, and the gradation correction table is corrected so that the deviation is reduced at the time of image formation. With this, based on the detection results of the patches T, for example, feedback control of the exposure amount and the developing bias is performed, and the variation in density of the output image can be corrected.

In the first embodiment, the configuration in which the image forming apparatus 100 performs the gradation control (density correction control) as the calibration. However, the calibration is not limited to the gradation control. As the calibration, color misregistration correction may be performed in addition to or in place of the gradation control. That is, from timings at which the optical sensor 7 detects the patches T, timings at which the patches T are formed in the belt conveyance direction (formation positions of the patches T) can be measured. Thus, based on detection results of the positions of the patches T for color misregistration correction for respective colors, the color misregistration is corrected by changing writing timings of the laser beams of the exposure devices 3 for respective colors, thereby being capable of forming a stable image. Also with regard to the patches T for color misregistration correction, similarly to the case of the gradation control, there may arise a problem of degradation in detection accuracy due to diffracted light described in detail later.

4. Intermediate Transfer Belt

Figure 4:
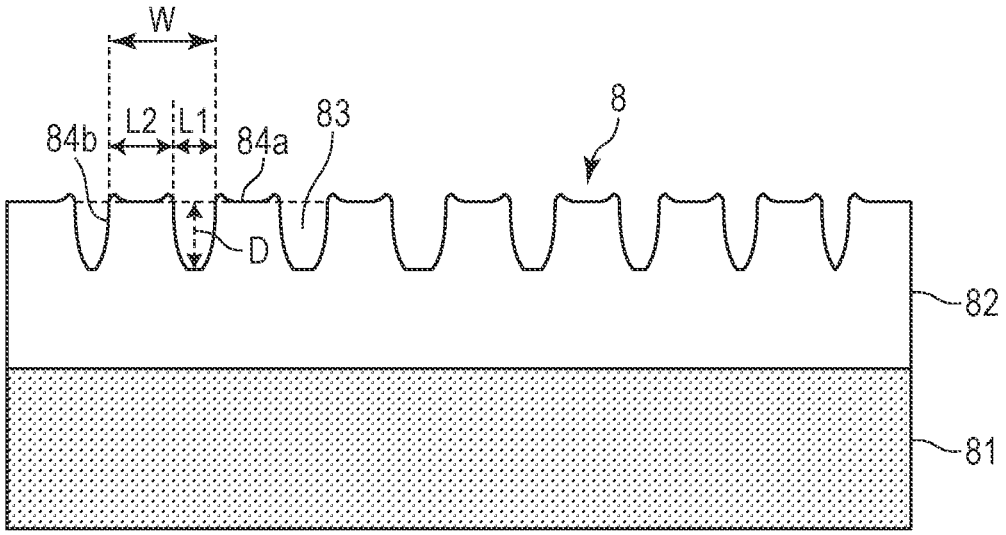
FIG. 4 is an enlarged partial sectional view for schematically illustrating an intermediate transfer belt.

Next, the intermediate transfer belt 8 according to the first embodiment is described. FIG. 4 is an enlarged partial sectional view for schematically illustrating the intermediate transfer belt 8 taken along a direction substantially orthogonal to the belt conveyance direction (as seen in the belt conveyance direction).

The intermediate transfer belt 8 is an endless belt member (or film-like member) formed of two layers including a base layer 81 and a top layer 82. The base layer 81 is a layer having the largest thickness among the layers forming the intermediate transfer belt 8. The top layer 82 is a layer forming the surface (outer peripheral surface) of the intermediate transfer belt 8 and being configured to bear the toner having been transferred thereto from the photosensitive drum 1.

In the first embodiment, the base layer 81 is a layer having a thickness of about 70 μm, which has a volume resistivity of $1\times10^{10}\cdot\Omega$cm adjusted by mixing carbon as a conducting agent in a polyethylene naphthalate resin. In the first embodiment, the polyethylene naphthalate resin is used as a material of the base layer 81, but the material is not limited thereto. As the thermoplastic resin, there may be used, for example, materials, such as polyimide, polyester, polycarbonate, polyarylate, an acrylonitrile-butadiene-styrene copolymer (ABS), polyphenylene sulfide (PPS), and polyvinylidene fluoride (PVdF), and mixed resins thereof. As a conducting agent, an ion conducting agent may be used besides an electron conducting agent.

Moreover, in the first embodiment, the top layer 82 is a layer having a thickness of about 3 μm, which is obtained by dispersing, for example, zinc oxide as an electric resistance adjusting agent in an acrylic resin. In the viewpoint of the strength such as wear resistance and crack resistance, it is preferred that a material of the top layer 82 be a resin material (curable resin) among curable materials. Among the curable resins, it is preferred that the acrylic resin which can be obtained by curing an unsaturated double-bond acrylic copolymer be employed. As the electric resistance adjusting agent (conducting agent), an ion conducting agent may be used besides an electron conducting agent.

In general, the urethane rubber and the acrylic resin have a large friction resistance against sliding, and are liable to cause curling of the cleaning blade 21 and chipping due to repeated use of the cleaning blade 21. The curling of the cleaning blade 21 corresponds to a state in which the free end portion of the cleaning blade 21 in abutment in the counter direction against the belt conveyance direction is curled so as to be brought into abutment along the belt conveyance direction.

In view of the above, in the first embodiment, the surface of the intermediate transfer belt 8 is subjected to fine projection/recess processing so that a plurality of grooves (groove shape or groove portion) 83 having an average groove interval W of 3.5 μm in the belt width direction are arranged side by side so as to extend along the belt conveyance direction. In the first embodiment, the grooves 83 are present over an entire area in a circumferential direction (belt conveyance direction) of the intermediate transfer belt 8. Moreover, in the first embodiment, the grooves 83 are present over an entire area in the width direction (belt width direction) of the intermediate transfer belt 8. It is only required that the grooves 83 be formed in substantially an entire area in the belt width direction in which the cleaning blade 21 and the intermediate transfer belt 8 are brought into abutment against each other (that is, an area equal to or larger than a width of the area in which the cleaning blade 21 and the intermediate transfer belt 8 are brought into abutment against each other).

As a fine protrusion/recess forming unit, in general, grinding, cutting, and imprinting are publicly known. In the first embodiment, the imprinting which enables formation of the groove interval W with high accuracy and is excellent in processing cost and productivity is employed.

Here, the groove interval W is obtained by measuring a distance between starting points of adjacent projection portions (in the illustrated example, between left end portions in the belt width direction) in a cross section substantially orthogonal to the belt conveyance direction. In the projection/recess shape formed by the imprinting, as a result of deformation caused by the top layer being pushed out, both ends of the projection portion may rise, or a width of a bottom of the groove may become smaller. For such a shape, the groove interval W is measured with an intersection between a substantially flat surface (horizontal surface) 84*a* at the top of the projection portion and a substantially flat surface (vertical surface) 84*b* formed upright toward the top of the projection portion from the bottom side of the groove as the starting point. Moreover, a distance between the vertical surfaces 84*b* in one recess is given as a width of the recess (hereinafter referred to also as "recess width") L1, and a distance between the vertical surfaces 84*b* in one projection portion is given as a width of the projection portion (hereinafter referred to also as "projection width") L2. Moreover, a distance between the horizontal surface 84*a* and the bottom portion of the recess (position located most on the base layer side) is given as a depth of the recess (or height of projection portion) D.

5. Grooves of Intermediate Transfer Belt

In the first embodiment, in order to suppress the influence on the output of the optical sensor 7 by the diffracted light caused by the projection/recess shape on the surface of the intermediate transfer belt 8, the groove intervals W in the projection/recess shape on the surface of the intermediate transfer belt 8 are not constant, and are regularly changed (modified or varied) within a predetermined range.

Figure 5A:
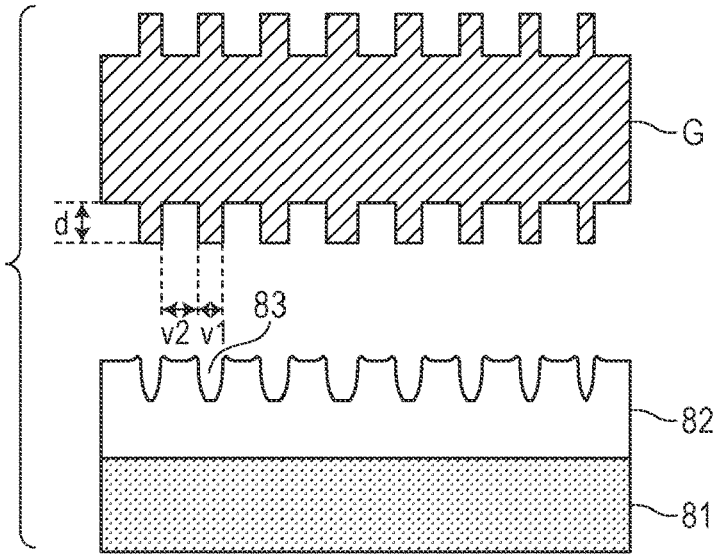
FIG. 5A is an enlarged partial sectional view for schematically illustrating a mold relating to a first embodiment.
Figure 5B:
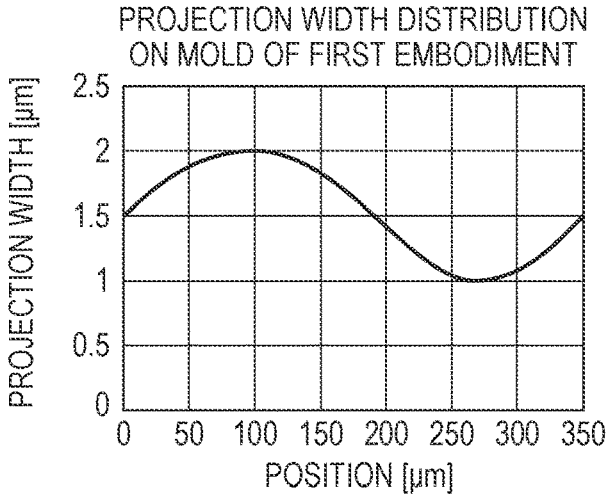
FIG. 5B is a graph for showing a projection width of the mold.
Figure 5C:
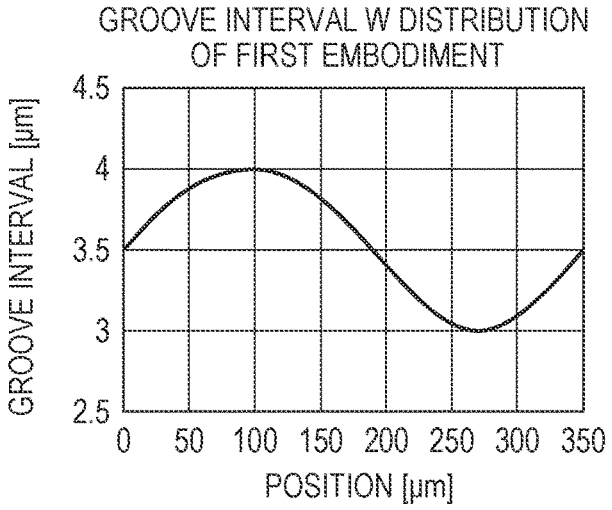
FIG. 5C is a graph for showing groove intervals of the intermediate transfer belt.

The upper view of FIG. 5A is a sectional view (cross section substantially orthogonal to the belt movement direction) for schematically illustrating a fine projection/recess forming mold (hereinafter simply referred to also as "mold"), and the lower view of FIG. 5A is a sectional view for schematically illustrating the intermediate transfer belt 8, which is similar to the sectional view of FIG. 4. Moreover, FIG. 5B is a graph for showing one period of distribution of widths of the projection portions of the mold (hereinafter referred to also as "projection width") v1. In FIG. 5B, the horizontal axis represents a position corresponding to a position in the belt width direction, and the vertical axis represents a projection width. Moreover, FIG. 5C is a graph for showing one period of the groove distribution of groove intervals W in the projection/recess shape on the surface of the intermediate transfer belt 8. In FIG. 5C, the horizontal axis represents a position in the width direction, and the vertical axis represents the groove interval W.

As illustrated in FIG. 5A, the mold G having a pattern formed in a shape reverse to the projection/recess shape to be formed on the surface of the intermediate transfer belt 8 is pressed against the intermediate transfer belt 8. As a result, the projection/recess shape which is reverse to the projection/recess shape on the mold is obtained on the surface of the intermediate transfer belt 8 (imprinting). At the time of the imprinting, first, a core (which has a diameter of 227 mm and is made of carbon tool steel) (not shown) is press-fitted along an inner peripheral surface side of the intermediate transfer belt 8 in a state in which the top layer 82 is formed on the base layer 81. The mold G having a columnar shape with a diameter of 50 mm and a length of 250 mm in a rotation axis direction is brought into press-contact with the surface of the intermediate transfer belt 8 having the core inserted thereinto with a pressing force of 12.5 kN so that substantially the entire area of the intermediate transfer belt 8 having a width of 250 mm can be processed. Then, through rotation of the intermediate transfer belt 8 and the mold G by one revolution of the intermediate transfer belt 8, the shape on the surface of the mold G is transferred to the surface of the intermediate transfer belt 8.

The recess shape on the mold G is formed as follows. That is, under a state in which a diamond bite having a blade edge width v2=2.0 μm is brought to enter the surface of the mold G by a depth d=1.0 μm an outer periphery of the mold G having a columnar shape is cut over one revolution, thereby forming a substantially constant recess shape having a width of 2.0 μm and a depth of 1.0 μm. Meanwhile, the projection shape on the mold G is formed as follows. The bite is moved by a desired distance along the rotation axis direction of the mold G, and after that, the outer periphery of the mold G having a columnar shape is cut again to form the recess shape, thereby forming the projection shape having desired projection widths v1. At this time, similar steps of cutting are repeatedly performed while periodically changing the movement amount of the bite, thereby forming the projection shape in which the projection widths v1 are periodically modified.

As shown in FIG. 5B, in the first embodiment, the projection widths v1 of the mold G are modified within a range of from 1.0 μm to 2.0 μm in a sinusoidal pattern having a period of 350 μm. In order to enable the imprinting over substantially the entire area of the width 250 mm of the intermediate transfer belt 8, the desired projection/recess shape is formed on substantially the entire area of the length of 250 mm in the rotation axis direction of the mold G on the surface of the mold G by repeatedly performing the cutting in the period mentioned above.

The projection/recess shape on the surface of the intermediate transfer belt 8 obtained through the transfer of the shape on the mold G was observed with use of a laser microscope VK-X250 manufactured by KEYENCE CORPORATION. As a result, as shown in FIG. 5C, the projection/recess shape on the surface of the intermediate transfer belt 8 was the desired projection/recess shape in which the groove intervals W are modified within a range of from 3.0 μm to 4.0 μm in the sinusoidal pattern having a period of 350 μm. In the projection/recess shape on the surface of the intermediate transfer belt 8 according to the first embodiment, the projection width L2 is substantially constant at 2.0 μm, and the depth D of the recess is substantially constant at 1.0 μm.

6. Effect of First Embodiment

Next, an effect of the first embodiment is described. Here, the reproducibility of a detection result for each revolution of the intermediate transfer belt 8 was evaluated based on a difference in output value of the optical sensor 7 in the first revolution and the second revolution when the intermediate transfer belt 8 was rotated by two revolutions under an environment with a temperature of 25° C. This is based on the above-mentioned method of calibration of the first embodiment. That is, in the calibration, density information of the patch T is determined by subtracting the reflected light amount from the background of the intermediate transfer belt 8 detected in the first revolution of the intermediate transfer belt 8 from the reflected light amount from the toner of the patch T detected in the second rotation of the intermediate transfer belt 8. Therefore, when the reflected light amounts from the background of the intermediate transfer belt 8 differ between the first revolution and the second revolution of the intermediate transfer belt 8, the accuracy of the density detection result of the patch T is degraded. Thus, here, the difference in output value of the optical sensor 7 between the first revolution and the second revolution of the intermediate transfer belt 8 described above is used as an indicator for the accuracy of the calibration.

Here, the difference in reflected light amount for each revolution of the intermediate transfer belt 8 is caused by the following factors. That is, the reflection characteristics from the surface of the intermediate transfer belt 8 differ depending on a position on the intermediate transfer belt 8 (belt conveyance direction or belt width direction). In each revolution of the intermediate transfer belt 8, a position of the intermediate transfer belt 8 slightly moves relative to a position at which the optical sensor 7 irradiates light due to, for example, a tolerance of a diameter of the drive roller 9*a*, a tolerance of a circumferential length of the intermediate transfer belt 8, and movement of the intermediate transfer belt 8 in the belt width direction. Such movement causes the difference in reflected light amount for each revolution of the intermediate transfer belt 8. Moreover, variation in reflection characteristics from the surface of the intermediate transfer belt 8 occurs because the strength and the reflection angle of the diffracted light differ depending on a position on the intermediate transfer belt 8 (belt conveyance direction or belt width direction) due to variation in groove shape (groove interval or depth) of the surface. In the first embodiment, the projection/recess shape on the surface of the intermediate transfer belt 8 is set so as to equalize the reflection characteristics from the surface of the intermediate transfer belt 8 and reduce the deviation in reflected light amount with respect to the positional deviation by suppressing the diffracted light from the surface of the intermediate transfer belt 8.

Figure 6:
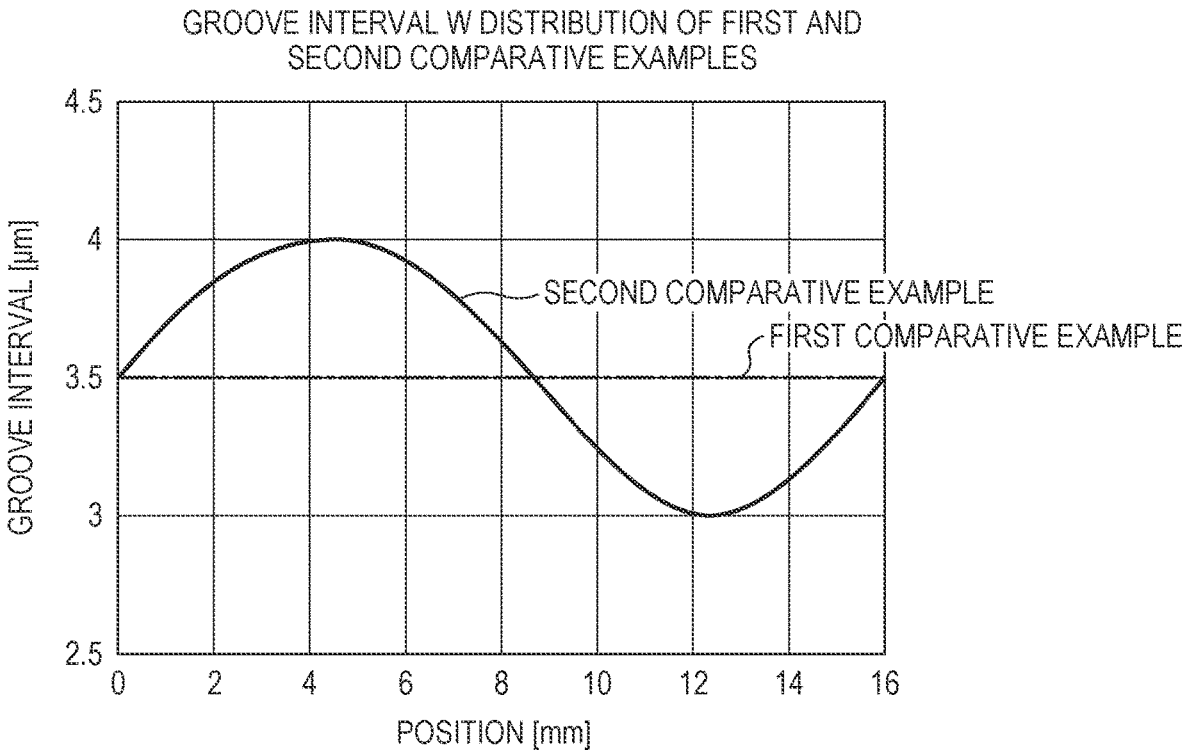
FIG. 6 is a graph for showing groove intervals of each of intermediate transfer belts of Comparative Examples 1 and 2.

Moreover, here, in order to verify the effect of the first embodiment, the evaluation similar to that for the first embodiment was conducted also for intermediate transfer belts 8 in which the groove intervals W in the projection/recess shape on the surface are set different from those of the first embodiment, as Comparative Examples 1 and 2. The intermediate transfer belt 8 of Comparative Example 1 is an intermediate transfer belt 8 in which the groove interval W is not modified and in which the projection width L2 of 2.0 μm and the recess width L1 of 1.5 μm, which are substantially constant, are given. The intermediate transfer belt 8 of Comparative Example 1 was produced under the same conditions as the first embodiment except that, at the time of producing the mold G, cutting was performed at equal intervals so that the projection widths v1 of the mold G are substantially constant. Moreover, the intermediate transfer belt 8 of Comparative Example 2 is an intermediate transfer belt 8 in which a modification period of the groove intervals W is larger than a spot diameter (about 2 mm) of the optical sensor 7. The intermediate transfer belt 8 of Comparative Example 2 was produced under the same conditions as those of the first embodiment except that the projection widths v1 of the mold G are modified within the range of from 1.0 μm to 2.0 μm in a sinusoidal pattern having a period of 16 mm. The projection/recess shape on the intermediate transfer belt 8 having been obtained through the transfer of the shape on the mold G was observed with use of a laser microscope VK-X250 manufactured by KEYENCE CORPORATION. FIG. 6 is a graph for showing one period of distribution of the groove intervals W in the projection/recess shape on the surface of each of the intermediate transfer belts 8 of Comparative Examples 1 and 2. The horizontal axis represents a position in the belt width direction, and the vertical axis represents the groove interval W. The projection/recess shape on the surface of the intermediate transfer belt 8 of Comparative Example 1 was a desired projection/recess shape having the groove interval W of 3.5 μm, which is substantially constant. Moreover, the projection/recess shape on the surface of the intermediate transfer belt 8 of Comparative Example 2 was a desired projection/recess shape having the groove intervals W modified within the range of from 3.0 μm to 4.0 μm in a sinusoidal pattern with a period of 16 mm.

Output voltages of the regular reflection light receiving element 72 and the diffused reflection light receiving element 73 of the optical sensor 7, which are given when the intermediate transfer belts 8 of the first embodiment, Comparative Example 1, and Comparative Example 2 are rotated by two revolutions, are shown in FIG. 7A, FIG. 7B, FIG. 7C, FIG. 7D, FIG. 7E, and FIG. 7F. The voltage output waveforms were obtained for each of the intermediate transfer belts 8 by adjusting a light amount of the light emitting element 71 so that an average value of the output voltage of the regular reflection light receiving element 72 is set to 2.5 V and thereafter monitoring output voltages of the light receiving elements 72 and 73 for a time period corresponding to two revolutions of the intermediate transfer belt 8. Moreover, a difference in voltage output of the light receiving elements 72 and 73 in the same phase between the first revolution and the second revolution of each of the intermediate transfer belts 8 was determined, and an average value of differences in the entire periphery of the intermediate transfer belt 8 and a standard deviation of the differences were determined. Results are shown in Table 1.

TABLE 1

| | Regular reflection | | Diffused reflection | |
|---|---|---|---|---|
| | Average | Standard deviation | Average | Standard deviation |
| First Embodiment | 3 mV | 128 mV | 1 mV | 13 mV |
| Comparative Example 1 | 94 mV | 204 mV | 21 mV | 17 mV |
| Comparative Example 2 | 47 mV | 134 mV | 11 mV | 15 mV |

As shown in Table 1, according to the first embodiment, for each of the regular reflection and the diffused reflection, the average value and the standard deviation of the difference in output voltage of the light receiving element in the same phase in the first revolution and the second revolution can be set smaller than those of Comparative Examples 1 and 2. That is, according to the first embodiment, the accuracy of the calibration can be improved as compared to Comparative Examples 1 and 2.

As mentioned above, the difference in reflected light amount for each revolution of the intermediate transfer belt 8 occurs when the variation in reflection characteristics of the surface of the intermediate transfer belt 8 due to the deviation in position of the intermediate transfer belt 8 for each revolution of the intermediate transfer belt 8 is detected. Thus, in the first embodiment, it can be said that the reflection characteristics of the surface of the intermediate transfer belt 8 are more equalized than those of Comparative Examples 1 and 2. Referring to the output voltages of the regular reflection light receiving element 72 shown in FIG. 7A, FIG. 7C, and FIG. 7E, there is a tendency that the change in output voltage value is the smallest in the first embodiment and becomes larger in Comparative Example 2 and Comparative Example 1 in the stated order. That is, in the first embodiment, there is a tendency that the reflection characteristics in the surface of the intermediate transfer belt 8 is more equalized than those of Comparative Examples 1 and 2.

Figure 7A:
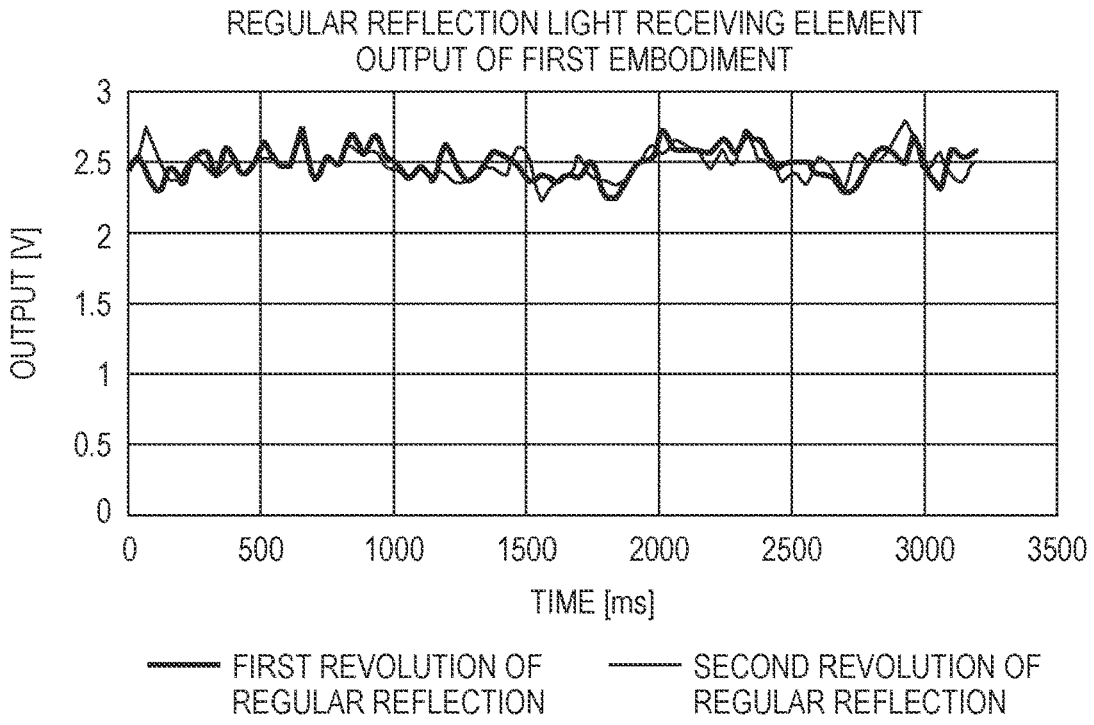
FIG. 7A is a graph for showing an output of a regular reflection light receiving element given as a result of two revolutions of the intermediate transfer belt of the first embodiment.
Figure 7B:
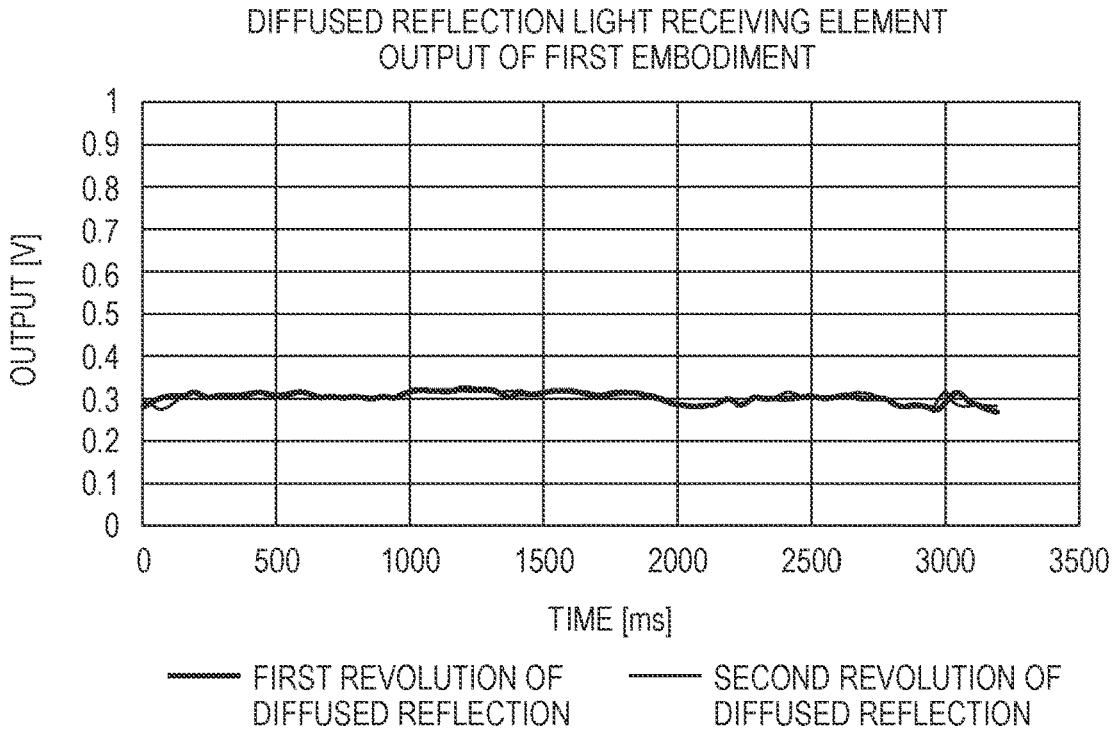
FIG. 7B is a graph for showing an output of a diffused reflection light receiving element given as a result of two revolutions of the intermediate transfer belt of the first embodiment.
Figure 7C:
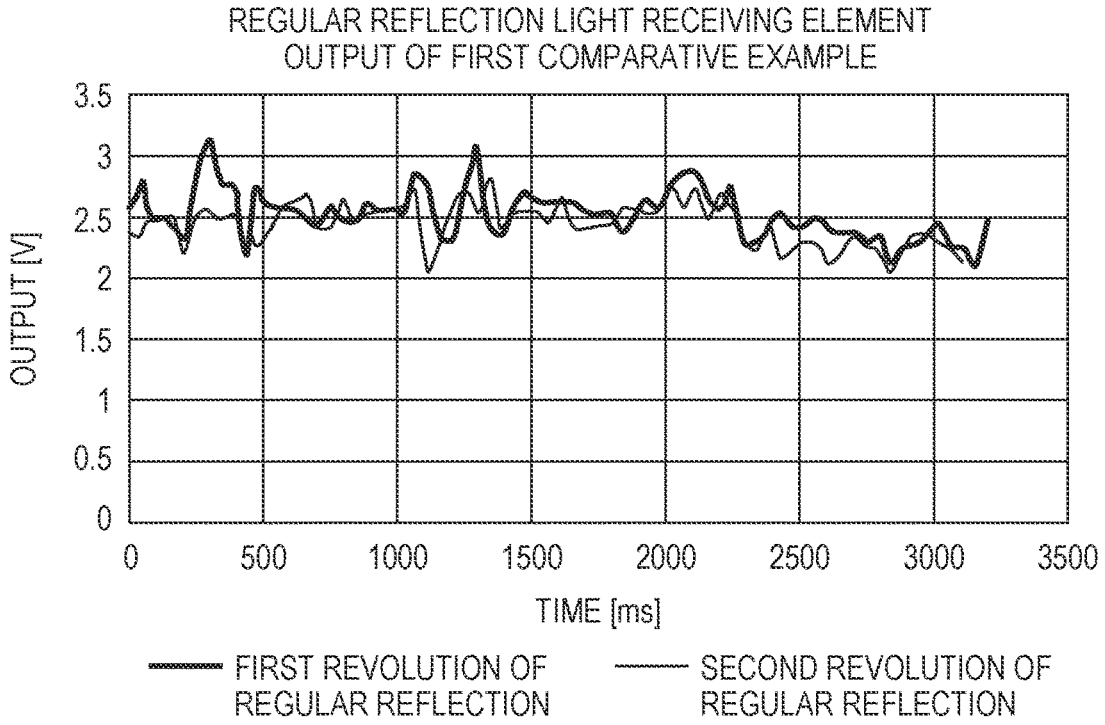
FIG. 7C is a graph for showing an output of the regular reflection light receiving element given as a result of two revolutions of the intermediate transfer belt of Comparative Example 1.
Figure 7D:
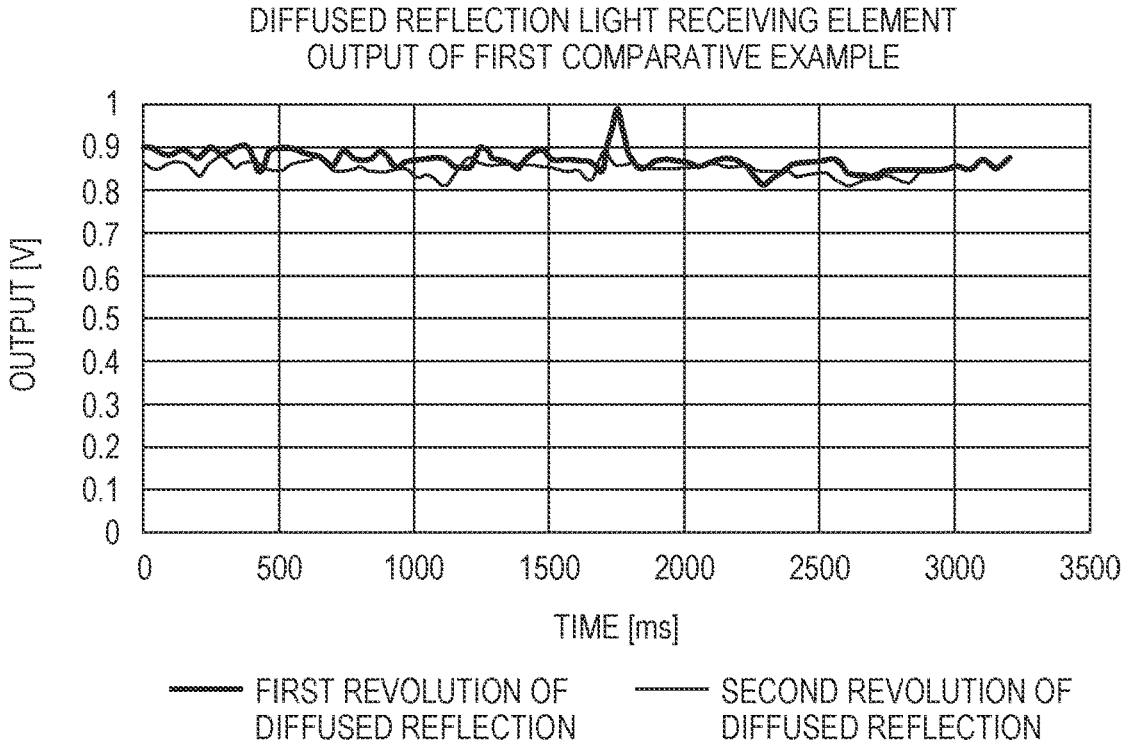
FIG. 7D is a graph for showing an output of the diffused reflection light receiving element given as a result of two revolutions of the intermediate transfer belt of Comparative Example 1.
Figure 7E:
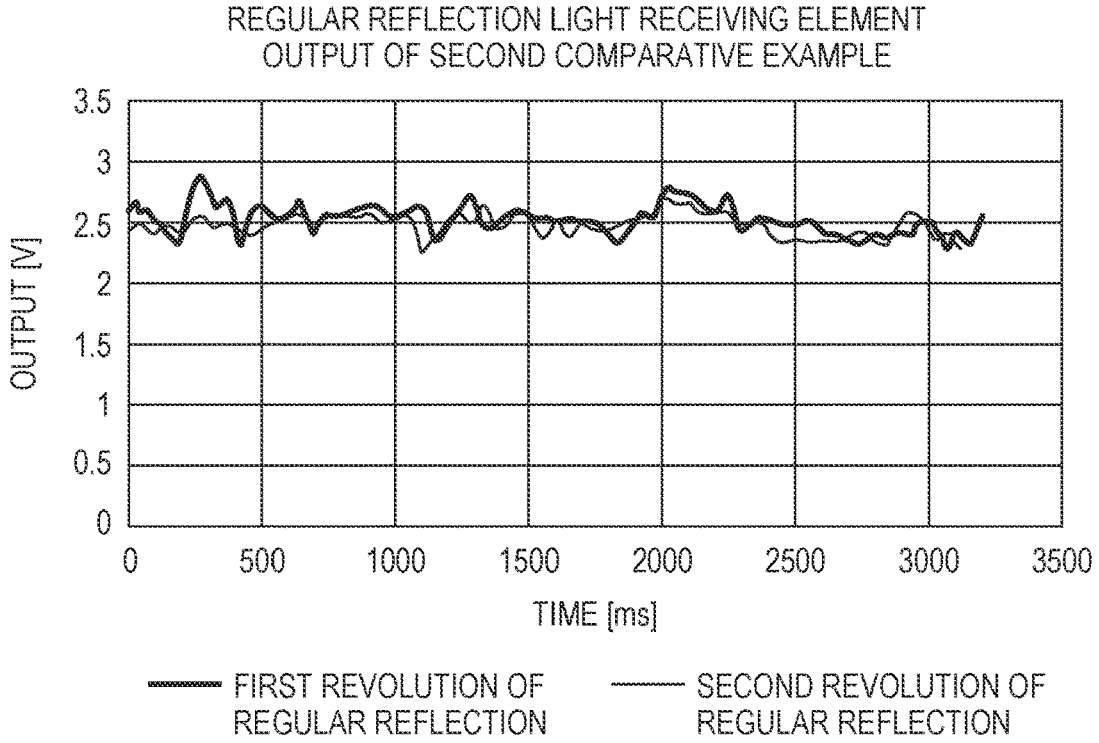
FIG. 7E is a graph for showing an output of the regular reflection light receiving element given as a result of two revolutions of the intermediate transfer belt of Comparative Example 2.
Figure 7F:
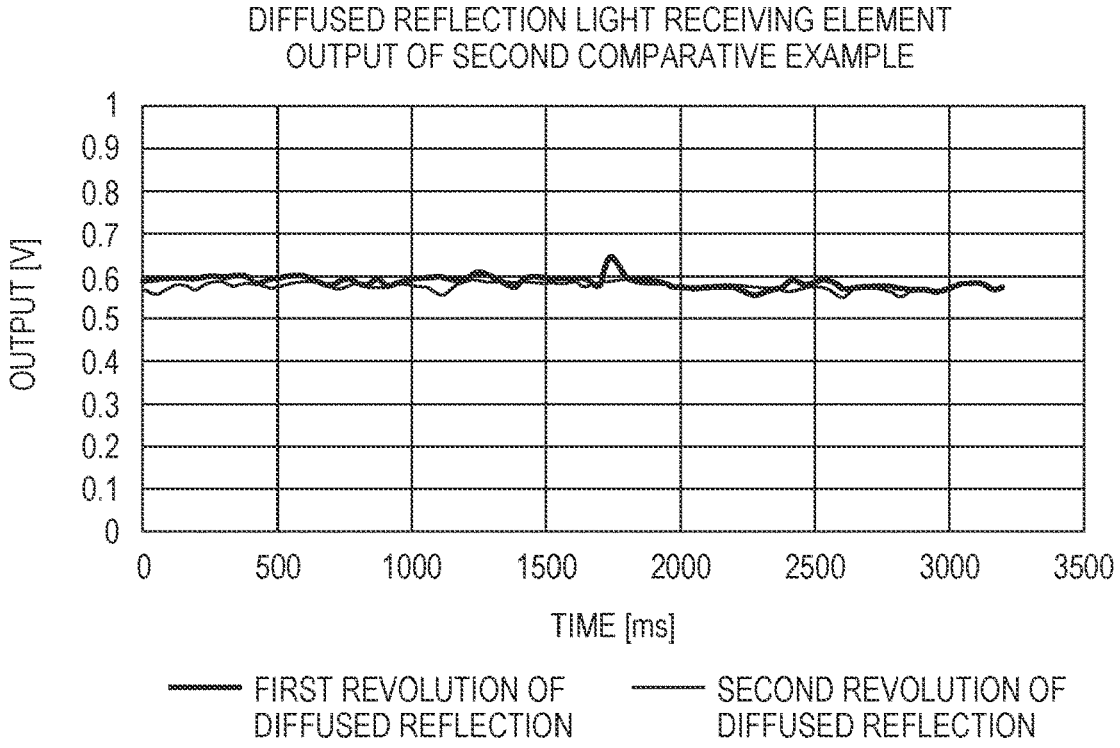
FIG. 7F is a graph for showing an output of the diffused reflection light receiving element given as a result of two revolutions of the intermediate transfer belt of Comparative Example 2.

Further, referring to the output voltages of the diffused reflection light receiving element 73 shown in FIG. 7B, FIG. 7D, and FIG. 7F, there is a tendency that the change in output voltage value is the smallest in the first embodiment and becomes larger in Comparative Example 2 and Comparative Example 1 in the stated order. This indicates that the diffracted light from the surface of the intermediate transfer belt 8 enters the diffused reflection light receiving element 73, and it can be said that unevenness of the reflection characteristics due to the diffraction is larger in Comparative Examples 1 and 2 than in the first embodiment.

Figure 8:
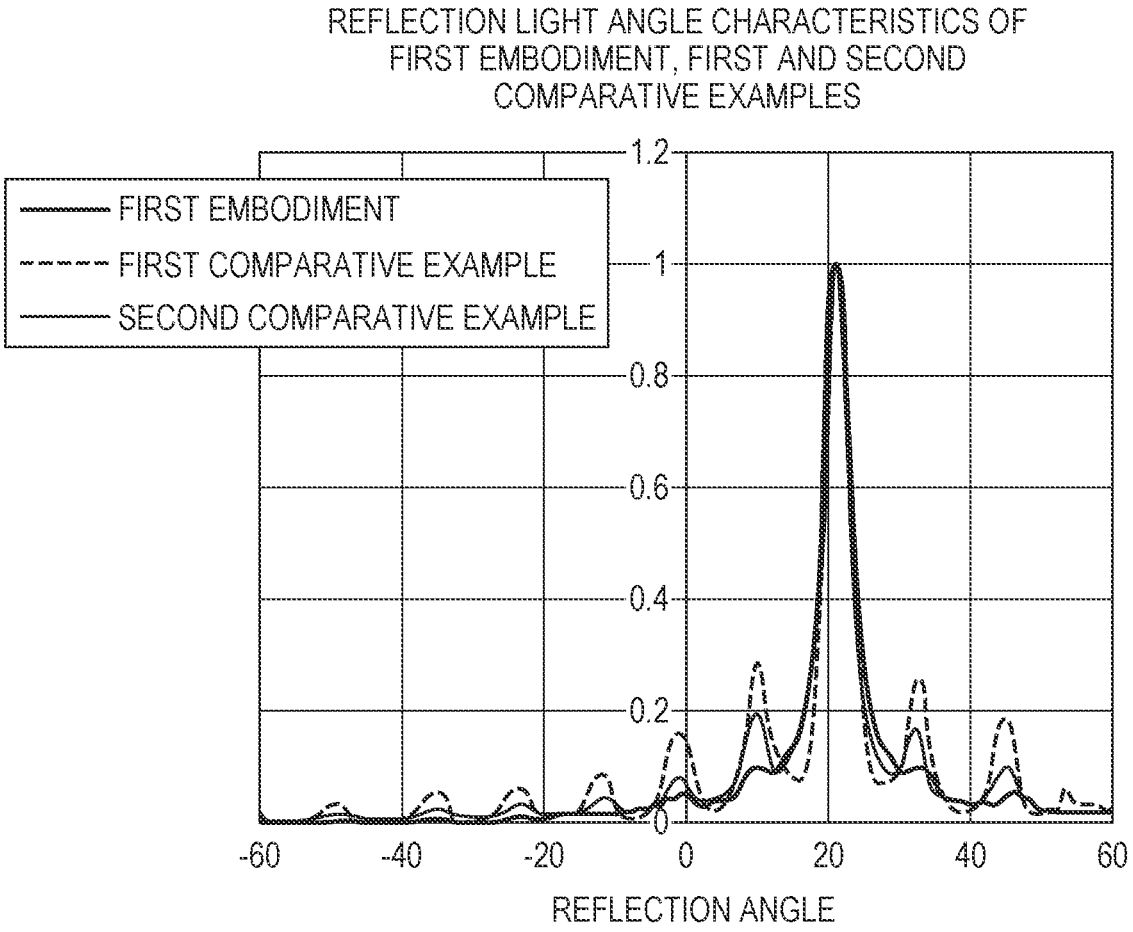
FIG. 8 is a graph for showing angle characteristics of reflected light from the intermediate transfer belt.

Here, for understanding of a condition of generation of the diffracted light from the surface of the intermediate transfer belt 8, FIG. 8 shows results of measurement of the angle distribution characteristics of the reflected light from the intermediate transfer belt 8. With regard to the angle distribution characteristics shown in FIG. 8, angle distribution characteristics of the reflected light given when the light having a wavelength λ of 622 nm is irradiated with use of Mini-Diff V1 (manufactured by CYBERNET SYSTEMS CO., LTD) at an incident angle −20° was measured, and a result obtained by normalization with a peak value in the distribution is shown. With the regular reflection light having a reflection angle of +20° as a center, a peak of intensity of the reflected light by the diffracted light can be seen for each predetermined angle. However, the peak intensity of the diffracted light is the smallest in the first embodiment and becomes larger in Comparative Example 2 and Comparative Example 1 in the stated order, and there is a tendency which is the same as the output voltage of the diffused reflection light receiving element 73 of FIG. 7B, FIG. 7D, and FIG. 7F.

In general, an equation indicating a diffraction angle from a reflection type diffraction grating is expressed by the following Expression 1, where a grating interval (groove interval in the first embodiment) is represented by W, a wavelength of the incident light is represented by λ, an incident angle of a light beam with respect to the normal direction is represented by θi, and a reflection angle is represented by θm, and a diffraction order is represented by "m" (m=±0, ±1, ±2, positive and negative integers).

$$W[\sin(\theta i)+\sin(\theta m)]=m\lambda \quad \text{(Expression 1)}$$

When m=0 is given (that is, in the case of regular reflection), θi=−θm is obtained. Thus, with regard to the regular reflection light, there is no dependency on the groove interval W and the wavelength λ.

With other orders, there is dependency on the groove interval W and the wavelength λ, and the reflected lights intensify each other at an angle θm at which the optical path difference of the reflected lights becomes multiples of integers of the wavelength. When Expression 1 is developed with regard to the diffraction angle θm, it is expressed by Expression 2.

$$\sin\theta m=mk/W-\sin\theta i \quad \text{(Expression 2)}$$

When the configuration of the optical sensor 7 of the first embodiment is applied, the wavelength λ=840 nm and θi=−20°, which are constant, are given, and hence the diffraction angle θm is uniquely determined by the groove interval W and the order "m" of the diffracted light. Therefore, when the groove interval W is an equal interval as in Comparative Example 1, as shown in FIG. 7D, a clear peak by the diffracted light is detected in the intensity of the reflected light with respect to an angle. In contrast, in the first embodiment, in the spot diameter (about 2 mm) of the irradiated light of the optical sensor 7, the groove intervals W are modified within the range of from 3.0 μm to 4.0 μm, and hence the diffraction angle from each groove is diffused. Therefore, in the first embodiment, as compared to Comparative Example 1, a clear peak of the intensity of the reflected light with respect to the angle is not identified. Meanwhile, in Comparative Example 2, the groove intervals W are modified within the range of from 3.0 μm to 4.0 μm, but the period of the modification is 16 mm, which is larger than the spot diameter (about 2 mm) of the irradiated light of the optical sensor 7. Therefore, in Comparative Example 2, the effect of diffusing the diffraction angle is small, and the effect of reducing the peak intensity of the diffracted light was smaller than that in the first embodiment. Moreover, in Comparative Example 2, the period of the modification of the groove intervals W is larger than the spot diameter (about 2 mm) of the irradiated light of the optical sensor 7, and hence, depending on the radiation position of the optical sensor 7 in the belt width direction, the average groove interval W in the spot diameter changes. Therefore, in Comparative Example 2, the change in intensity of the reflected light caused by the positional deviation of the intermediate transfer belt 8 became larger than that of the first embodiment.

As described above, according to the first embodiment, the diffracted light is diffused to reduce the peak intensity of the diffracted light so that the reflection characteristics within the surface of the intermediate transfer belt 8 is equalized, thereby being capable of improving the accuracy of the calibration. Meanwhile, also with Comparative Example 2, as compared to the case of the equal groove interval W as in Comparative Example 1, the accuracy of the calibration can be improved. That is, it is preferred that the period of the modification of the groove intervals W be sufficiently small, for example, equal to or smaller than the spot diameter of the optical sensor 7, but a certain effect can be obtained even when the period is larger than the spot diameter. It is preferred that a lower limit of the period of the modification of the groove intervals W be set to be larger by about ten times or more with respect to the average value of the groove intervals W. With regard to an upper limit value, the upper limit can be set in the viewpoint of obtaining a certain modification amount in the spot diameter, and it is preferred that, in the first embodiment, the upper limit fall within the range of equal to or larger than 35 μm and equal to or smaller than 5 mm. However, with regard to the upper limit value, as mentioned above, in the viewpoint of setting the upper limit to be sufficiently smaller than the spot diameter, it is more preferred that the range of the upper limit be equal to or smaller than 2,000 μm, still more preferably equal to or smaller than 500 μm.

It is conceivable to design so that the diffracted light does not enter the light receiving portion based on, for example, the arrangement of the optical sensor 7. However, even in this case, due to variation in components (sensors or belt surface irregularities) or the like, the diffracted light may enter the light receiving portion or may not enter the light receiving portion, with the result that the accuracy of the calibration may be degraded. In this regard, according to the first embodiment, the diffracted light is diffused as mentioned above, and the peak intensity of the diffracted light is reduced, so that the reflection characteristics within the surface of the intermediate transfer belt 8 can be equalized, thereby being capable of improving the accuracy of the calibration in any of the above-mentioned cases.

Next, for each of the first embodiment, Comparative Example 1, and Comparative Example 2, a test for checking cleaning performance was conducted. Here, under an environment with a temperature of 30° C. and a humidity of 80%, A4-sized GF-0081 (manufactured by Canon Inc.) was used to conduct a durability test of forming 150,000 text images with a print ratio (image ratio) of 5%. As a result, in all of the first embodiment, Comparative Example 1, and Comparative Example 2, passing of the toner through the cleaning blade 21 or large chipping that may cause a problem in the cleaning blade 21 did not occur, and a desired cleaning performance was obtained.

In the first embodiment, the projection widths v1 of the mold G (recess widths L1 of the intermediate transfer belt 8) are modified within the range of from 1.0 μm to 2.0 μm, but the effect of improving the accuracy of the calibration can be obtained even when the modification amount (modification width) of the recess widths L1 of the intermediate transfer belt 8 is changed. Specifically, when the modification amount of the groove intervals W of the intermediate transfer belt 8 is set to be larger, the peak intensity of the diffracted light can be further reduced, thereby being capable of obtaining more favorable effect. Meanwhile, when the projection widths v1 of the mold G (recess widths L1 of the intermediate transfer belt 8) are excessively small, falling of the projection portion is more liable to occur at the time of cutting of the mold G. Moreover, in contrast, when the projection widths v1 of the mold G (recess widths L1 of the intermediate transfer belt 8) are excessively large and become larger than the particle diameter of the toner to be used, passing of the toner through the cleaning blade 21 becomes more liable to occur. Therefore, it is preferred that the modification amount of the groove intervals W of the intermediate transfer belt 8 be determined in view of the processability and the particle diameter of the toner. In the viewpoint of suppressing the falling of the projection portion of the mold G, it is preferred that the recess widths L1 of the intermediate transfer belt 8 (projection widths v1 of the mold G) be equal to or larger than 0.5 μm. Moreover, for example, in the viewpoint of suppressing the passing of the toner through the cleaning blade 21, it is preferred that the recess widths L1 of the intermediate transfer belt 8 be smaller than the average particle diameter of the toner. It is more preferred that the recess widths L1 of the intermediate transfer belt 8 be smaller than a half of the average particle diameter of the toner. In the configuration of the first embodiment, it is preferred that the recess widths L1 of the intermediate transfer belt 8 (projection widths v1 of the mold G) fall within the range of equal to or larger than about 0.5 μm and equal to or smaller than about 6.0 μm, more preferably the range of equal to or larger than 1.0 μm and equal to or smaller than 2.0 μm. The groove intervals W of the intermediate transfer belt 8 can be suitably selected in the viewpoint of suppressing wear of the cleaning blade 21, but it is preferred that the groove intervals W of the intermediate transfer belt 8 fall within the range of equal to or larger than about 2.0 μm and equal to or smaller than about 50 μm, more preferably the range of equal to or larger than 3.0 μm and smaller than 10.0 μm. When the groove intervals W are excessively small, in some cases, it may become difficult to form a uniform projection/recess shape. Moreover, when the groove interval W is excessively large, in some cases, it may be difficult to suppress the wear of the cleaning blade 21.

Moreover, for example, in the viewpoint of suppressing the projection portion from being lost due to shaving of the top layer of the intermediate transfer belt 8, it is preferred that the depth D of the recess of the intermediate transfer belt 8 be set to be equal to or larger than 0.2 μm and smaller than a thickness of the top layer 82. When the depth D of the recess is set to be smaller than the thickness of the top layer 82, the groove 83 is formed so as to be present only on the top layer 82 without reaching the base layer 81. Here, it is preferred that the thickness of the top layer of the intermediate transfer belt 8 be equal to or larger than about 1.0 μm and equal to or smaller than about 5.0 μm, more preferably equal to or larger than 1.0 μm and equal to or smaller than 3.0 μm in the viewpoint of suppressing degradation in durability due to an excessively small thickness and cracks of the top layer due to an excessively large thickness.

Moreover, in the first embodiment, the groove intervals W are modified through modification of the projection widths v1 of the mold G (recess widths L1 of the intermediate transfer belt 8), but the same effect as the first embodiment can be obtained also with a configuration in which the projection widths L2 of the intermediate transfer belt 8 are modified. Specifically, for example, an inverted mold is obtained through nickel electroforming from the mold G produced in the same manner as the first embodiment, and the inverted mold is processed into a roll shape and is imprinted on the intermediate transfer belt 8. With this, the intermediate transfer belt 8 having the modified projection widths L2 can be obtained, thereby being capable of obtaining the same effect as the first embodiment. Also in this case, it is preferred that the recess widths L1 and the groove intervals W of the intermediate transfer belt 8 fall within the above-mentioned ranges.

Moreover, in the first embodiment, the projection widths v1 of the mold G are processed so that the groove intervals W are periodically modified over an overall width of 250 mm of the intermediate transfer belt 8. In contrast, in the viewpoint of achieving processability, the groove intervals W may be modified only at the opposing portion of the optical sensor 7. Specifically, for example, in consideration of the positional deviation tolerance in the belt width direction with respect to the spot diameter of the optical sensor 7, the groove intervals W may be modified only within a range to which a predetermined width is added about the radiation position of the optical sensor 7 in the belt width direction, and an equal groove interval W may be given in other areas. For example, when the spot diameter is about 2 mm as in the first embodiment, the groove intervals W are modified only within a range of about 8 mm about the radiation position of the optical sensor 7 in the belt width direction, and an equal groove interval W is given in other areas. With this, the same effect as the first embodiment can be obtained while improving the processability of the mold G. In this case, it is preferred that the groove interval at the portion having equal groove intervals W and the average groove interval W (3.5 μm in the first embodiment) at the portion having modified groove intervals W be equal to each other. This is because unevenness in friction coefficient between the cleaning blade 21 and the intermediate transfer belt 8 is suppressed from occurring, and the stable cleaning performance can be obtained.

Figure 10A:
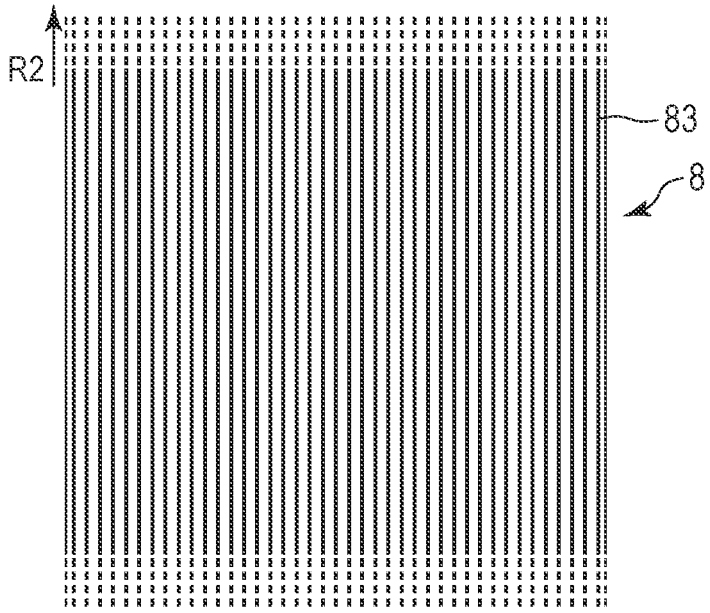
FIG. 10A is a plan view for schematically illustrating the intermediate transfer belt, and is an illustration of grooves formed in a surface of the intermediate transfer belt.
Figure 10B:
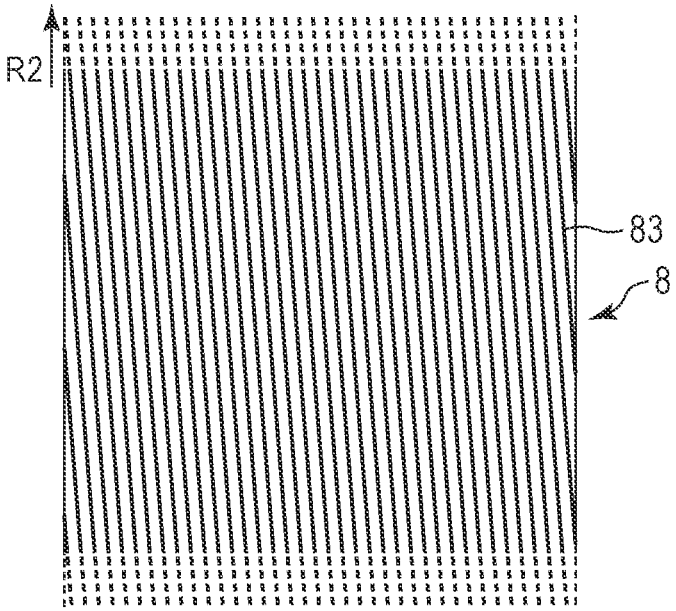
FIG. 10B is a plan view for schematically illustrating the intermediate transfer belt, and is an illustration of grooves formed in the surface of the intermediate transfer belt.

Moreover, in the first embodiment, the grooves 83 extend in the direction along the belt conveyance direction and are formed so as to be substantially parallel to the belt conveyance direction (FIG. 10A). Moreover, in the first embodiment, the grooves 83 are substantially linearly formed in a continuous manner over the circumference in the circumferential direction (rotation direction) of the intermediate transfer belt 8. However, it is only required that the direction extending along the belt conveyance direction extend along the direction intersecting the belt width direction, and an angle may be given with respect to the belt conveyance direction (FIG. 10B). FIG. 10A is a schematic plan view for illustrating the intermediate transfer belt 8 in a case in which the grooves 83 are formed so as to be substantially parallel to the belt conveyance direction. FIG. 10B is a schematic plan view for illustrating the intermediate transfer belt 8 in a case in which the grooves 83 are formed so as to have an angle with respect to the belt conveyance direction. It is preferred that the angle of the longitudinal axis direction of the grooves 83 with respect to the belt conveyance direction be equal to or smaller than 45 degrees, more preferably equal to or smaller than 10 degrees. Typically, as in the first embodiment, the belt conveyance direction and the longitudinal axis direction of the grooves 83 are substantially parallel to each other. Also in the case in which the grooves 83 are formed so as to have an angle with respect to the belt conveyance direction, similarly to the configuration described above, for example, the groove interval W, the recess width L1, and the projection width L2 are set to values which are measured in a cross section substantially orthogonal to the belt conveyance direction. The grooves 83 having an angle with respect to the belt conveyance direction can be formed through use of the mold G having the projection portion formed obliquely with respect to the rotation direction of the column, or through use of the mold G having the projection portion formed so as to be substantially parallel to the rotation direction of the column as in the embodiment with a center axis of the mold G being inclined with respect to the width direction of the intermediate transfer belt.

Moreover, due to the difficulty in completely matching the starting point and the ending point of the grooves 83 in the belt conveyance direction, or due to the oblique formation of the grooves 83 with respect to the belt conveyance direction, there may be provided a portion at which the starting point side and the ending point side of the grooves 83 overlap each other at a part in the belt conveyance direction. The length in the belt conveyance direction of the area in which the grooves 83 overlap each other in the belt conveyance direction is smaller than the length of other areas in the belt conveyance direction. In this case, in the area in which the grooves 83 overlap each other in the belt conveyance direction, the groove interval W is different from that in other areas (typically, the average groove interval W becomes smaller), and it is conceivable that the groove interval W is not modified in the manner mentioned above. Also in this case, when the groove intervals W are modified as mentioned above in the area other than the area in which the grooves 83 overlap each other, the calibration can be performed, for example, through formation of the patches T avoiding the area in which the grooves 83 overlap each other, thereby being capable of sufficiently obtaining the effect of the first embodiment.

Moreover, the state in which the groove intervals W are regularly changed (modified or varied) typically corresponds to a state in which the groove intervals W are changed in a predetermined period in a predetermined waveform but is not limited thereto. For example, there is a case of including an area in which the groove intervals W vary while partially deviating from the predetermined waveform due to the reason relating to manufacture or intentionally. For example, it is conceivable that the groove intervals W that change in the predetermined period in the predetermined waveform as a whole is set constant partially in the belt width direction so that the waveform is non-continuous. Alternatively, it is conceivable that the period of the change in groove intervals W that change in the predetermined waveform as a whole is varied (extended or shortened) partially in the belt width direction. The case in which the deviation follows a predetermined pattern as well as a case in which the deviation irregularly (randomly) occurs are included in the regular change in the groove intervals W. That is, the state in which the groove intervals W regularly change may be the state that can be determined such that the groove intervals W do not irregularly (randomly) vary and that, with reference to technical common knowledge in the field, the groove intervals W follow the predetermined pattern as a whole in an area in which at least the groove intervals W are to be modified. In other words, when the groove intervals W are represented in a coordinate system having a horizontal axis representing a position in the belt width direction and a vertical axis representing the groove interval W, the groove intervals W change within a predetermined range with an increasing area (first area) in which the groove intervals W continuously increase as the position in the belt width direction changes in one direction and a decreasing area (second area) in which the groove intervals W continuously decrease as the position in the belt width direction changes in the one direction. For example, in the example shown in FIG. 5C, the area in which the groove intervals W increase from 3.0 μm to 4.0 μm is the increasing area, and the area in which the groove intervals W decrease from 4.0 μm to 3.0 μm is the decreasing area. Typically, at least one increasing area and at least one decreasing area are continuous with each other. Moreover, typically, the increasing areas and the decreasing areas are alternately repeated in the belt width direction. It is preferred that the period of alternate repetition be smaller than a width in the let width direction (spot diameter) on the intermediate transfer belt 8 within the range in the belt width direction of the intermediate transfer belt 8 to which the light is irradiated by the optical sensor 7.

As described above, in the first embodiment, the plurality of grooves 83 extending along the belt conveyance direction are arranged side by side in the belt width direction on the surface of the intermediate transfer belt 8. The plurality of grooves 83 include the plurality of grooves 83 in which the intervals (groove intervals) W of the grooves, which are formed within a range of the intermediate transfer belt 8 (range of spot diameter) in at least the belt width direction to which the light is irradiated by the optical sensor 7 and are adjacent to each other in the belt width direction, are regularly changed within the predetermined range. Typically, the change in the groove intervals W is a periodical change in the belt width direction. Moreover, the period of the periodical change is smaller than the width (spot diameter) of the range of the intermediate transfer belt 8 in the belt width direction to which the light is irradiated by the optical sensor 7. Moreover, the change in groove intervals W may be brought about by the change in widths of the grooves 83 in the belt width direction, or may be brought about by the change in width of the projection portion between the adjacent grooves in the belt width direction. Moreover, the plurality of grooves 83 formed outside the range of the intermediate transfer belt in the belt width direction to which the light is irradiated by the optical sensor 7 may have a substantially equal groove interval W. In such a case, it is preferred that the average interval between grooves in which the groove interval W changes and the interval between grooves having an equal groove interval W be substantially equal to each other.

As described above, according to the first embodiment, keeping the cleaning performance for a long period of time, which is the effect obtained by giving the projection/recess shape to the surface of the intermediate transfer belt 8, and maintaining the accuracy of the calibration can both be achieved.

Second Embodiment

Next, another embodiment of the present disclosure will be described. A basic configuration and an operation of an image forming apparatus according to a second embodiment are the same as those of the image forming apparatus according to the first embodiment. Thus, in the image forming apparatus according to the second embodiment, elements having functions or configurations which are the same as or correspond to those of the image forming apparatus according to the first embodiment are denoted by the same reference symbols as those of the first embodiment, and a detailed description is omitted.

In the second embodiment, a mode of modification of the projection widths v1 of the mold G (recess widths L1 of the intermediate transfer belt 8) is different from that of the first embodiment.

Figure 9A:
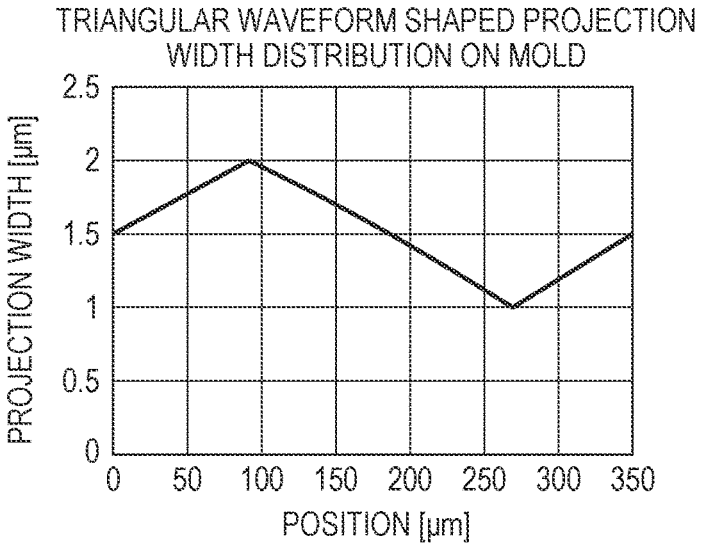
FIG. 9A and FIG. 9B are graphs for showing projection widths of each of molds relating to a second embodiment.
Figure 9B:
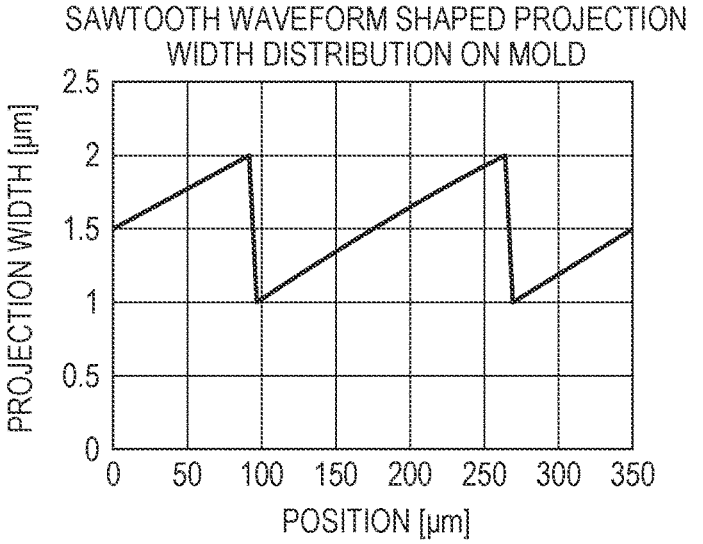
Figure 9C:
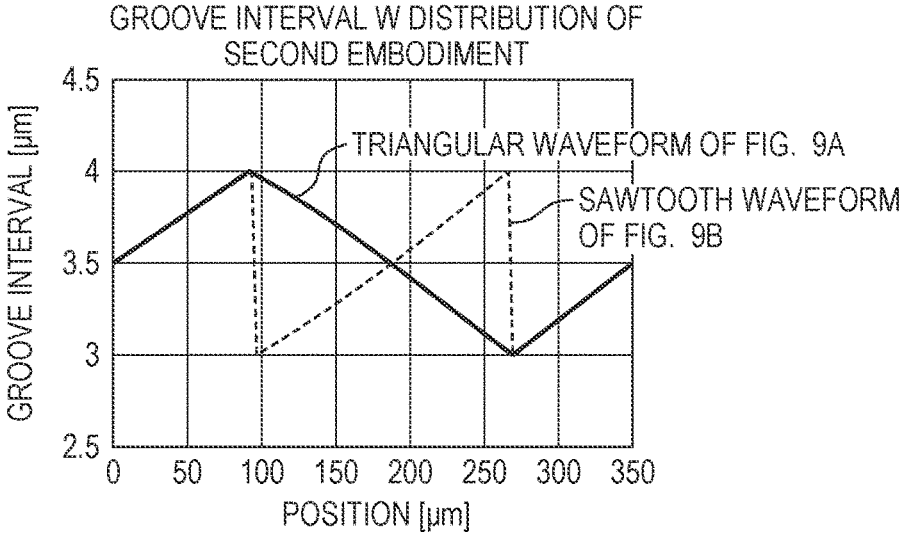
FIG. 9C is a graph for showing groove intervals of the intermediate transfer belt.

FIG. 9A and FIG. 9B are each a graph for showing one period of distribution of the projection widths v1 of the mold G of the second embodiment. Moreover, FIG. 9C is a graph for showing one period of distribution of the groove intervals W in the projection/recess shape on the surface of the intermediate transfer belt 8 formed by the mold G exhibiting the distribution of the projection widths v1 shown in FIG. 9A and FIG. 9B. In the example of FIG. 9A, the projection widths v1 of the mold G are modified within the range of from 1.0 μm to 2.0 μm in a triangular wave pattern having a period of 350 μm. In the example shown in FIG. 9B, the projection widths v1 of the mold G are modified within the range of from 1.0 μm to 2.0 μm in a saw-like waveform having a period of 175 μm.

The recess shape of the mold G is formed in a manner similar to that of the first embodiment. That is, under a state in which a diamond bite having a blade edge width v2=2.0 μm is brought to enter the surface of the mold G by a depth d=1.0 μm, an outer periphery of the mold G having a columnar shape is cut over one revolution, thereby forming a substantially constant recess shape having a width of 2.0 μm and a depth of 1.0 μm. The projection shape of the mold G is formed in the same manner as the first embodiment. That is, the bite is moved by a desired distance along the rotation axis direction of the mold G, and after that, the outer periphery of the mold G having a columnar shape is cut again to form the recess shape. Such operation is repeatedly performed to form the projection shape having the distribution of the projection width v1 shown in FIG. 9A and FIG. 9B. Moreover, the intermediate transfer belt 8 according to the second embodiment is produced under the same condition as the first embodiment except that the projection width v1 of the mold G is different.

The projection/recess shape on the surface of the intermediate transfer belt 8 obtained through the transfer of the shape on the mold G was observed in the same manner as described in the first embodiment. As a result, as shown in FIG. 9C, the projection/recess shape on the surface of the intermediate transfer belt 8 was the desired projection/recess shape in which the groove intervals W are modified within a range of from 3.0 μm to 4.0 μm in the triangular wave pattern having a period of 350 μm (die shown in FIG. 9A) and a saw-like waveform having a period of 175 μm (die shown in FIG. 9B).

Also with regard to the intermediate transfer belt 8 according to the second embodiment, in the manner similar to that described in the first embodiment, a test for evaluating the accuracy of calibration was conducted. That is, a difference in voltage output of the light receiving elements 72 and 73 in the same phase between the first revolution and the second revolution of the intermediate transfer belts 8 was determined, and an average value of differences in the entire periphery of the intermediate transfer belt 8 and a standard deviation of the differences were determined. Results are shown in Table 2. The second embodiments (A) and (B) shown in Table 2 represent the intermediate transfer belts 8 of the second embodiment produced with use of the molds G for FIG. 9A and FIG. 9B. Moreover, in Table 2, the results of the first embodiment are also shown for comparison.

TABLE 2

| | Regular reflection | | Diffused reflection | |
|---|---|---|---|---|
| | Average | Standard deviation | Average | Standard deviation |
| First Embodiment | 3 mV | 128 mV | 1 mV | 13 mV |
| Second Embodiment (A) | 4 mV | 130 mV | 2 mV | 15 mV |
| Second Embodiment (B) | 3 mV | 120 mV | 2 mV | 13 mV |

As shown in Table 2, according to the second embodiment, the difference in output voltage of the light receiving element can be suppressed to the same difference in output voltage as the first embodiment, thereby being capable of improving the accuracy of the calibration similarly to the first embodiment. This is because the groove intervals W of the intermediate transfer belt 8 are modified, similarly to the first embodiment, within the range of from 3.0 μm to 4.0 μm having the period of 350 μm. That is, the effect of diffusing the diffracted light can be similarly obtained regardless of the shape of the modification waveform of the groove intervals W.

As described above, the effect achieved through the modification of the groove intervals W can be obtained regardless of the modification waveform.

The shape of the modification waveform of the groove intervals W is not limited to the sinusoidal wave, the triangular wave, and the saw-like wave, and the same effect can be obtained by achieving the waveform modified so as to have periods even with use of higher-order function.

[Other]

In the above, the present disclosure has been described based on the specific embodiments. However, the present disclosure is not limited to the embodiments mentioned above.

In the embodiments mentioned above, the intermediate transfer member is formed of a plurality of layers. However, even when the intermediate transfer member having a single-layer configuration is employed, the same effect as those of the embodiments mentioned above can be obtained by forming grooves in the surface of the intermediate transfer belt. That is, the intermediate transfer member is not limited to the configuration including a plurality of layers, and may have a configuration including a single layer. In such a case, it is only required that the surface of the single layer has the same shape as the surface of the top layer given in the embodiments described above. Moreover, also in the configuration of the intermediate transfer member including a plurality of layers, the number of layers is not limited to two. The layer corresponding to the base layer of the embodiment mentioned above may be formed of a plurality of layers, or single layer or a plurality of layers may be provided in a layer below a layer corresponding to the base layer of the embodiments mentioned above.

Moreover, the intermediate transfer member is not limited to the one having a belt shape. The present disclosure may be similarly applied to even a drum-shaped intermediate transfer member (intermediate transfer drum) formed, for example, by stretching a sheet around a frame body to thereby obtain the same effect.

Moreover, the image forming apparatus is not limited to an image forming apparatus of an in-line type. For example, there may be employed an image forming apparatus of a secondary transfer type, which includes a plurality of developing device with respect to one photosensitive member and is configured to primarily transfer, in a sequential manner, toner images sequentially formed on the photosensitive member to the intermediate transfer member and thereafter secondarily transfer the toner images superimposed on one another on the intermediate transfer member to a transfer material.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-115036, filed Jun. 20, 2019, which is hereby incorporated by reference herein in its entirety.

What is claimed is:

1. An image forming apparatus comprising:

an image bearing member configured to bear a toner image;

an intermediate transfer member, onto which the toner image is to be transferred from the image bearing member, and which is movable;

a detection unit configured to irradiate the toner image on the intermediate transfer member with light to detect reflected light; and a control unit configured to perform control of adjusting a condition for forming the toner image based on a detection result of the detection unit, wherein, in a surface of the intermediate transfer member, a plurality of grooves extending along a movement direction of the surface of the intermediate transfer member are formed side by side in a width direction of the intermediate transfer member intersecting the movement direction, and wherein grooves, formed within a range of the intermediate transfer member to which the light is irradiated by the detection unit with respect to at least the width direction, among the plurality of grooves are formed so that intervals each between adjacent grooves with respect to the width direction are regularly changed within a predetermined range.

2. The image forming apparatus according to claim 1, wherein a change in intervals is a periodic change with respect to the width direction, and wherein a period of the periodic change is smaller than a width of the range of the intermediate transfer member to which the light is irradiated by the detection unit with respect to the width direction.

3. The image forming apparatus according to claim 2, wherein the intervals are periodically changed with respect to the width direction by difference in widths of the grooves with respect to the width direction.

4. The image forming apparatus according to claim 2, wherein the intervals are periodically changed with respect to the width direction by intervals of projection portions each between the adjacent grooves being changed with respect to the width direction.

5. The image forming apparatus according to claim 1, wherein grooves, formed outside the range of the intermediate transfer member to which the light is irradiated by the detection unit which respect to the width direction, among the plurality of grooves are formed so that the intervals each between the adjacent grooves with respect to the width direction are substantially equal.

6. The image forming apparatus according to claim 5, wherein an average interval between the grooves in which the intervals are changed and an interval of the grooves in which the intervals are substantially equal are substantially equal to each other.

7. The image forming apparatus according to claim 1, wherein a width of each of the plurality of grooves with respect to the width direction is smaller than an average particle diameter of toner.

8. The image forming apparatus according to claim 1, further comprising a cleaning member configured to abut against the intermediate transfer member to remove toner from the intermediate transfer member, wherein with respect to the width direction, the plurality of grooves are formed over a substantially entire of an area in which the cleaning member and the intermediate transfer member abut against each other.

9. An image forming apparatus comprising:

an image bearing member configured to bear a toner image, an intermediate transfer member, onto which the toner image is to be transferred from the image bearing member, and which is movable, a detection unit configured to irradiate the toner image on the intermediate transfer member with light to detect reflected light; and a control unit configured to perform control of adjusting a condition for forming the toner image based on a detection result of the detection unit, wherein, in a surface of the intermediate transfer member, a plurality of grooves extending along a movement direction of the surface of the intermediate transfer member are formed side by side in a width direction of the intermediate transfer member intersecting the movement direction, and wherein grooves, formed within a range of the intermediate transfer member to which the light is irradiated by the detection unit with respect to at least the width direction, among the plurality of grooves are formed so that intervals each between adjacent grooves with respect to the width direction are changed within a predetermined range having a first area and a second area, the first area being an area in which an interval continuously increases as a position in the width direction changes in one direction in a coordinate system having a horizontal axis representing the position in the width direction and a vertical axis representing the interval, and the second area being an area in which an interval continuously decreases as a position in the width direction changes in the one direction in the coordinate system.

10. The image forming apparatus according to claim 9, wherein the first area and the second area are adjacent to each other.

11. The image forming apparatus according to claim 9, wherein the first area and the second area are alternately and repeatedly arranged with respect to the width direction.

12. The image forming apparatus according to claim 11, wherein a period, in which the first area and the second area are alternately and repeatedly arranged with respect to the width direction, is smaller than a width of the range of the intermediate transfer member to which the light is irradiated by the detection unit with respect to the width direction.

13. The image forming apparatus according to claim 9, wherein the intervals are changed with respect to the width direction by difference in widths of the grooves with respect to the width direction.

14. The image forming apparatus according to claim 9, wherein the intervals are changed with respect to the width direction by intervals of projection portions each between the adjacent grooves being changed with respect to the width direction.

15. An intermediate transfer member, which is to be used in an image forming apparatus, and onto which a toner image is transferred from an image bearing member, and to which light is irradiated by a detection unit in the image forming apparatus, the intermediate transfer member comprising a plurality of grooves, which are formed in a surface of the intermediate transfer member, and which are formed side by side in a width direction of the intermediate transfer member intersecting a movement direction of the surface of the intermediate transfer member, wherein the plurality of grooves extend along the movement direction of the surface of the intermediate transfer member in the image forming apparatus, and wherein grooves, formed within a range of the intermediate transfer member to which the light is irradiated by the detection unit with respect to at least the width direction, among the plurality of grooves are formed so that intervals each between adjacent grooves with respect to the width direction are regularly changed within a predetermined range.

16. An intermediate transfer member according to claim 15, wherein a change in intervals is a periodic change with respect to the width direction, and wherein a period of the periodic change is smaller than a width of the range of the intermediate transfer member to which the light is irradiated by the detection unit with respect to the width direction.

17. The intermediate transfer member according to claim 15, wherein the intervals are changed with respect to the width direction by difference in widths of the grooves with respect to the width direction.

18. The intermediate transfer member according to claim 15, wherein the intervals are changed with respect to the width direction by intervals of projection portions each between the adjacent grooves being changed with respect to the width direction.

19. The intermediate transfer member according to claim 15, wherein a width of each of the plurality of grooves with respect to the width direction is smaller than an average particle diameter of toner.

* * * * *